US011458750B2

(12) United States Patent
Bizen et al.

(10) Patent No.: US 11,458,750 B2
(45) Date of Patent: Oct. 4, 2022

(54) ACCOMMODATION BODY AND TAPE PRINTING SYSTEM

(71) Applicant: SEIKO EPSON CORPORATION, Tokyo (JP)

(72) Inventors: Mizuki Bizen, Matsumoto (JP); Taishi Sasaki, Matsumoto (JP); Akio Ishimoto, Shiojiri (JP); Yuki Hatayama, Tsukuba (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/891,439

(22) Filed: Jun. 3, 2020

(65) Prior Publication Data

US 2020/0398598 A1 Dec. 24, 2020

(30) Foreign Application Priority Data

Jun. 19, 2019 (JP) ..... JP2019-113502

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01); *B41J 15/046* (2013.01)

(58) Field of Classification Search
CPC ..... B41J 15/044; B41J 3/4075; B41J 15/046
See application file for complete search history.

(56) References Cited

U.S. PATENT DOCUMENTS 4,073,231 A * 2/1978 Roser ..... B41K 3/20 101/116
5,610,648 A * 3/1997 Sims ..... B41J 3/4075 347/172
6,812,943 B1 * 11/2004 Day ..... B41J 35/36 347/171
10,166,795 B2 1/2019 Kubota et al.
2004/0056143 A1 * 3/2004 Nonomura ..... B65H 16/06 242/596.8
2005/0269026 A1 * 12/2005 Takahashi ..... B65C 9/25 156/277
2007/0009302 A1 * 1/2007 Vandermeulen ..... B41J 35/22 400/207

(Continued)

FOREIGN PATENT DOCUMENTS

EP 0734872 A2 10/1996
EP 2202082 A1 6/2010

(Continued)

OTHER PUBLICATIONS

Nov. 18, 2020 Extended Search Report issued in European Patent Application No. 20179754.5.

*Primary Examiner* — David H Banh
(74) *Attorney, Agent, or Firm* — Oliff PLC

(57) ABSTRACT

Disclosed is an accommodation body including: a tape roll accommodation part in which a tape roll on which a tape to be fed to a tape printing apparatus is wound is accommodated; a wall part that is provided with a tape discharge port from which the tape fed from the tape roll is to be discharged; and a cartridge accommodation part in which a ribbon cartridge that has an ink ribbon and is to be installed in the tape printing apparatus while retaining the tape fed from the tape roll is accommodated.

7 Claims, 19 Drawing Sheets

(56) References Cited

U.S. PATENT DOCUMENTS

| | | | | |
|---|---|---|---|---|
| 2007/0211099 | A1* | 9/2007 | Lyons | B41J 3/60 347/16 |
| 2012/0057917 | A1* | 3/2012 | Van Britsom | B41J 17/32 400/613 |
| 2014/0202295 | A1* | 7/2014 | Carson | B32B 38/0004 83/23 |
| 2016/0288550 | A1* | 10/2016 | Suzuki | B41J 3/4075 |
| 2018/0079238 | A1 | 3/2018 | Kubota et al. | |
| 2018/0354281 | A1* | 12/2018 | Sato | B41J 3/4075 |

FOREIGN PATENT DOCUMENTS

| | | | |
|---|---|---|---|
| EP | 3278998 | A1 | 2/2018 |
| JP | H08-039878 | A | 2/1996 |
| JP | H09-216444 | A | 8/1997 |
| JP | 2002-347780 | A | 12/2002 |

* cited by examiner

ACCOMMODATION BODY AND TAPE PRINTING SYSTEM

CROSS REFERENCES TO RELATED APPLICATIONS

The entire disclosure of Japanese Patent Application No. 2019-113502, filed on Jun. 19, 2019 is expressly incorporated by reference herein.

BACKGROUND

1. Technical Field

This application relates to an accommodation body in which a tape roll on which a tape to be fed to a tape printing apparatus is wound is accommodated and a tape printing system.

2. Related Art

Conventionally, a rendering tape cartridge in which a tape roll with a release paper on which a tape with the release paper to be fed to a rendering tape printing machine is wound is accommodated has been known as disclosed in JP-A-8-039878.

SUMMARY

In a conventional rendering tape cartridge, an ink ribbon cassette to be installed in a rendering tape printing machine is not accommodated. Therefore, it is necessary to separately perform an operation to install the ink ribbon cassette and an operation to install a tape with a release paper fed from the rendering tape cartridge with respect to the rendering tape printing machine.

An embodiment of the application provides an accommodation body including: a tape roll accommodation part in which a tape roll on which a tape to be fed to a tape printing apparatus is wound is accommodated; a wall part that is provided with a tape discharge port from which the tape fed from the tape roll is to be discharged; and a cartridge accommodation part in which a ribbon cartridge that has an ink ribbon and is to be installed in the tape printing apparatus while retaining the tape fed from the tape roll is accommodated.

Another embodiment of the application provides a tape printing system including: a tape printing apparatus; and an accommodation body including a tape roll accommodation part in which a tape roll on which a tape to be fed to the tape printing apparatus is wound is accommodated, a wall part on which a tape discharge port from which the tape fed from the tape roll is to be discharged is provided, and a cartridge accommodation part in which a ribbon cartridge that has an ink ribbon and is to be installed in the tape printing apparatus is accommodated, the ribbon cartridge being capable of retaining the tape fed from the tape roll.

DESCRIPTION OF EXEMPLARY EMBODIMENTS

Figure 1:
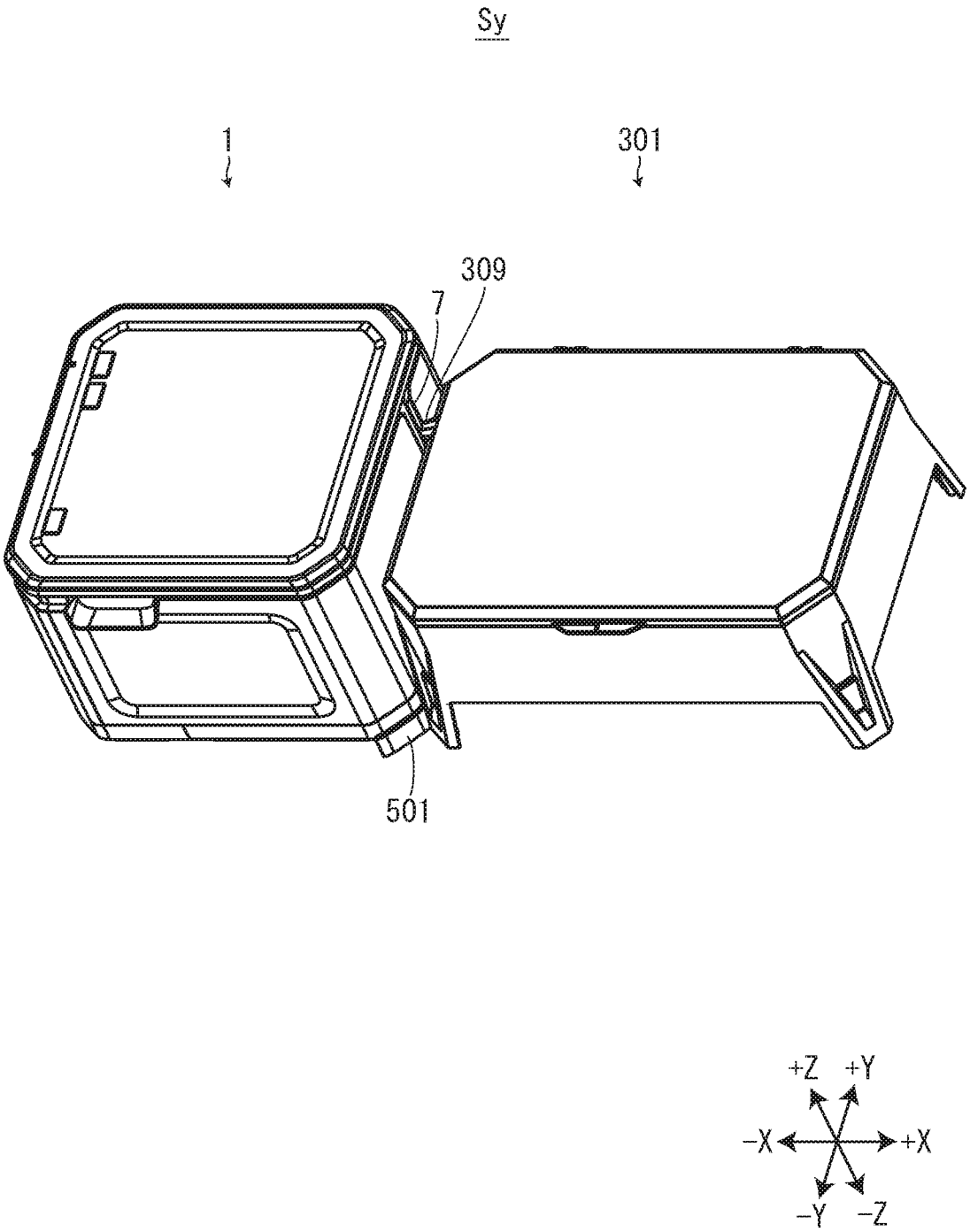
FIG. 1 a perspective view showing a tape printing apparatus and an accommodation body.

Hereinafter, an embodiment of an accommodation body and a tape printing system will be described with reference to the accompanying drawings. Note that an XYZ orthogonal coordinate system shown in the drawings is given only for the convenience of illustration and does not intend to limit the following embodiment. However, a +Z direction indicates an upper direction, and a −Z direction indicate a lower direction. Further, all numeric values indicating the numbers of respective parts are given only for illustration and do not intend to limit the following embodiment.

(Tape Printing System)

Figure 2:
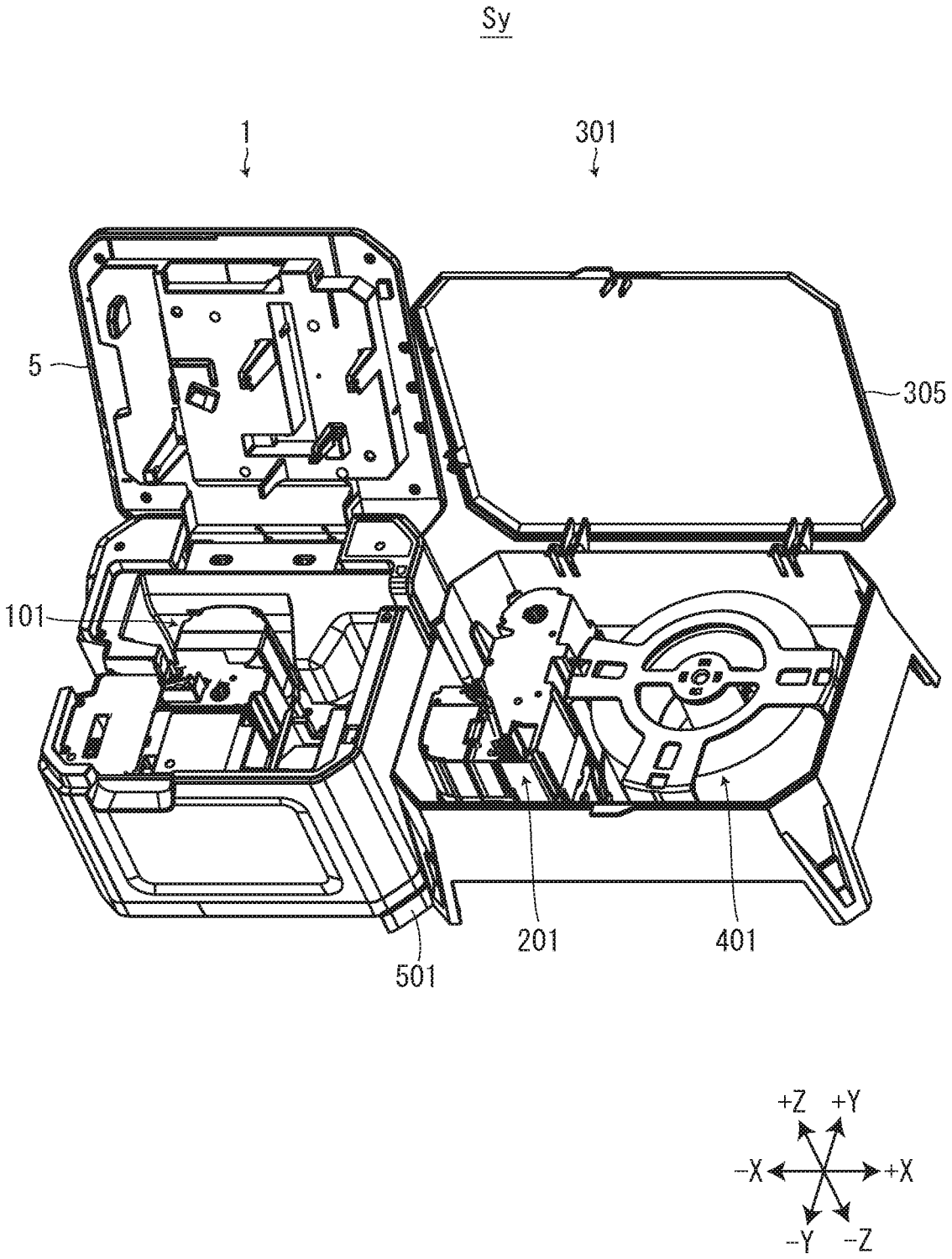
FIG. 2 is a perspective view showing the tape printing apparatus in which a tape cartridge is installed and the accommodation body in which a ribbon cartridge and a tape supplying body are accommodated.
Figure 3:
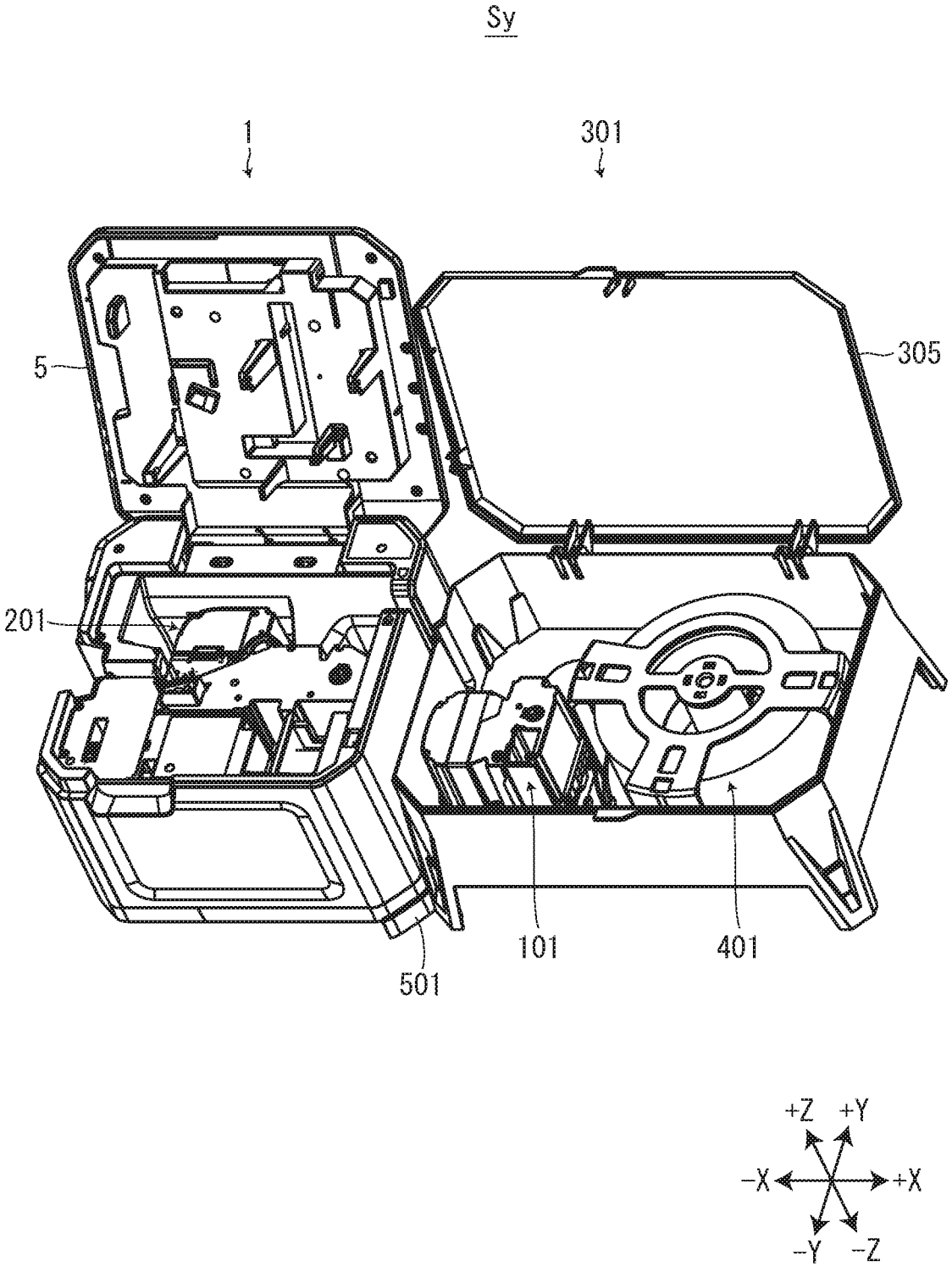
FIG. 3 is a perspective view showing the tape printing apparatus in which the ribbon cartridge is installed and the accommodation body in which the tape cartridge and the tape supplying body are accommodated.

As shown in FIGS. 1 to 3, a tape printing system Sy includes a tape printing apparatus 1 and an accommodation body 301. The tape printing apparatus 1 and the accommodation body 301 are coupled to be separable from each other via a coupling member 501. The tape printing apparatus 1 performs a printing process on the basis of print data received from an information processing apparatus such as a personal computer and a smart phone not shown in the figures. A tape cartridge 101 and a ribbon cartridge 201 are alternatively installed in the tape printing apparatus 1. Further, a tape supplying body 401 is accommodated in the accommodation body 301.

As shown in FIG. 2, a second tape 411 is not fed from the tape supplying body 401 accommodated in the accommodation body 301 to the tape printing apparatus 1 when the tape cartridge 101 is installed in the tape printing apparatus 1. The tape printing apparatus 1 performs printing on a first tape 113 using the first tape 113 and a first ink ribbon 117 (see FIG. 6) accommodated in the installed tape cartridge 101. Note that the ribbon cartridge 201 not used for printing at this time is accommodatable in the accommodation body 301.

As shown in FIG. 3, the second tape 411 (see FIG. 10) is fed from the tape supplying body 401 accommodated in the accommodation body 301 to the tape printing apparatus 1 when the ribbon cartridge 201 is installed in the tape printing apparatus 1. The tape printing apparatus 1 performs printing on the second tape 411 using the fed second tape 411 and a second ink ribbon 217 (see FIG. 8) accommodated in the installed ribbon cartridge 201. Note that the tape cartridge 101 not used for printing at this time is accommodatable in the accommodation body 301.

(Tape Printing Apparatus)

Figure 4:
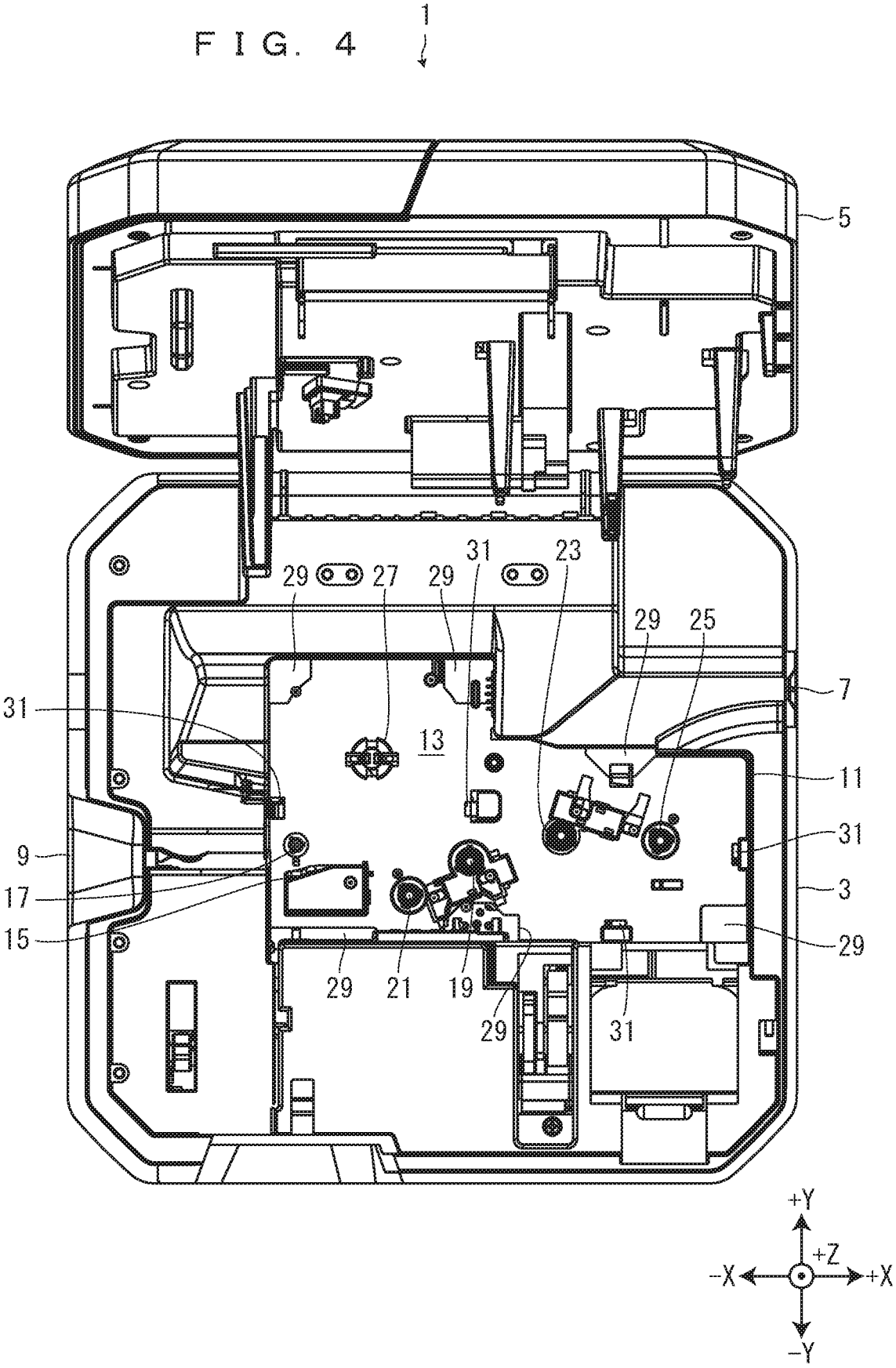
FIG. 4 is a view of the tape printing apparatus when seen from a +Z side.

As shown in FIG. 4, the tape printing apparatus 1 includes an apparatus case 3 and an installation-part cover 5. The +X side surface of the apparatus case 3 is provided with a tape introduction port 7, and the −X side surface thereof is provided with a tape discharging port 9. The second tape 411 fed from the tape supplying body 401 to the tape printing apparatus 1 is introduced into the apparatus case 3 via the tape introduction port 7. The first tape 113 fed from the tape cartridge 101 installed in the tape printing apparatus 1 or the second tape 411 introduced via the tape introduction port 7 is discharged to the outside of the apparatus case 3 via the tape discharging port 9.

The installation-part cover 5 is turnably attached at the +Y side end of the apparatus case 3 and used to open and close the cartridge installation part 11. The cartridge installation part 11 is formed into a recessed shape that is open on the +Z side. A printing head 15 is provided on an installation bottom surface 13 that is the button surface of the cartridge installation part 11. The printing head 15 is a thermal head including a heat generation element. A platen shaft 17, a first winding shaft 21, a first feeding shaft 19, a second feeding shaft 23, and a second winding shaft 25 are sequentially provided on the installation bottom surface 13 in this order from the −X side.

Further, an installation core insertion part 27, six installation protrusion parts 29, and four installation hooks 31 are provided on the installation bottom surface 13. The installation core insertion part 27 is formed into a substantially-stepped columnar shape and inserted into a first core recessed part 123 (see FIG. 7) or a second core recessed part 223 (see FIG. 9) that will be described later. The six installation protrusion parts 29 are provided at the peripheral part of the installation bottom surface 13. The four installation hooks 31 engage first hook engagement parts 121 (see FIG. 7) or second hook engagement parts 221 (see FIG. 9) that will be described later to retain the tape cartridge 101 or the ribbon cartridge 201.

Figure 5:
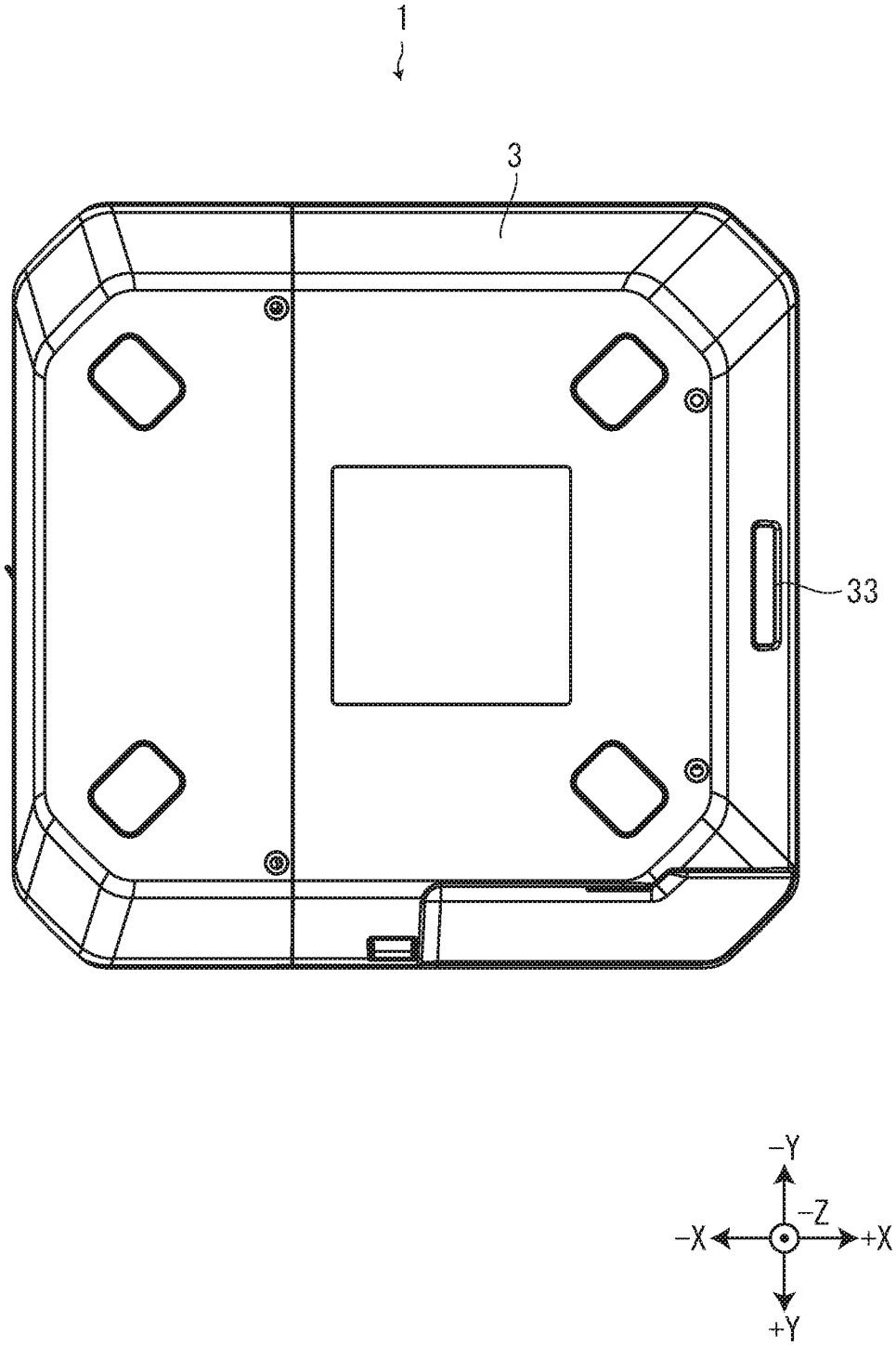
FIG. 5 is a view of the tape printing apparatus when seen from a −Z side.

The −Z side surface of the apparatus case 3 is provided with a printing-body engagement part 33 at the +X side end (see FIG. 5). The printing-body engagement part 33 is a substantially-rectangular opening long in a Y-axis and engages a coupling second engagement part 505 (see FIG. 18) of the coupling member 501.

(Tape Cartridge)

Figure 6:
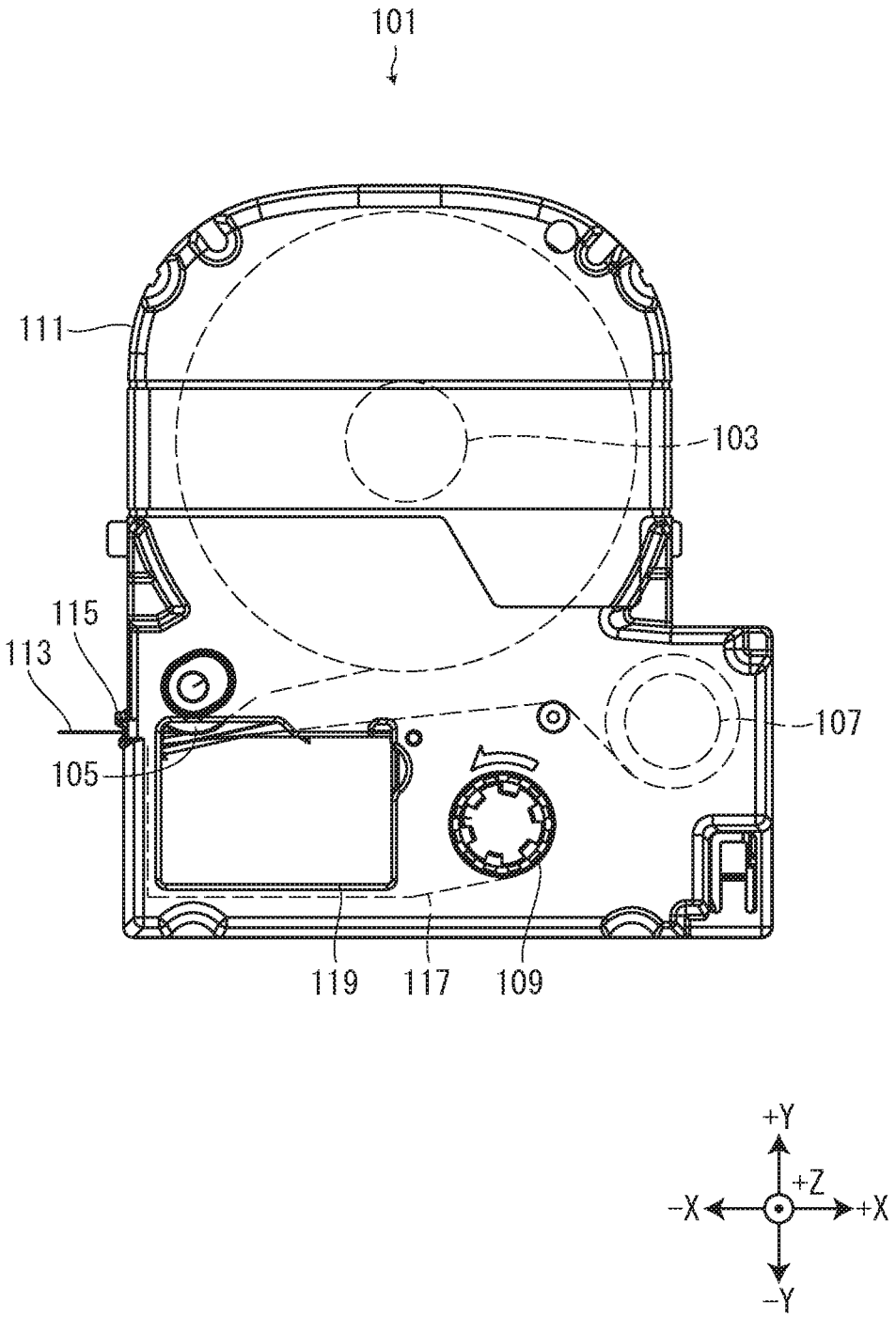
FIG. 6 is a view of the tape cartridge when seen from the +Z side.
Figure 7:
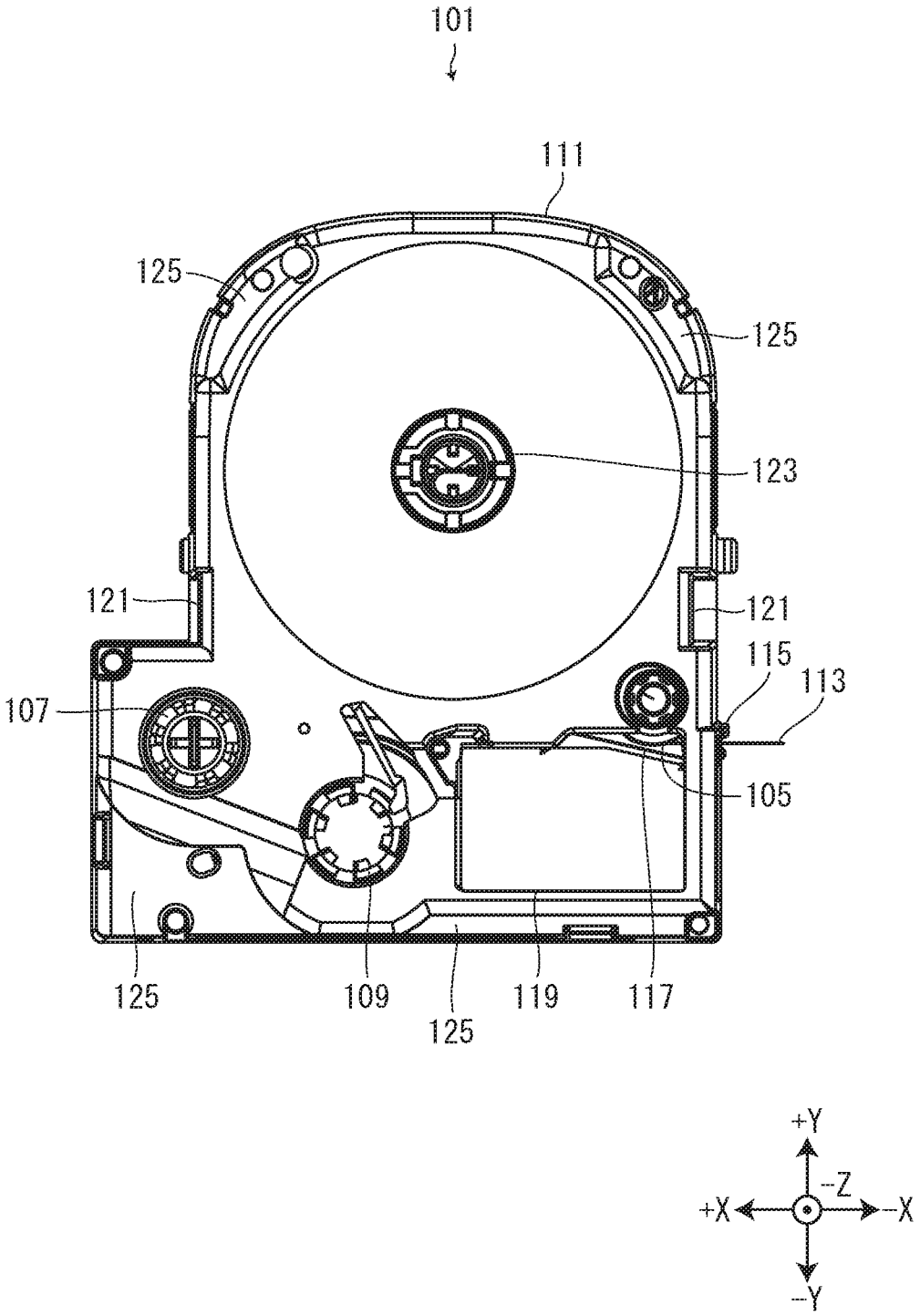
FIG. 7 is a view of the tape cartridge when seen from the −Z side.

As shown in FIGS. 6 and 7, the tape cartridge 101 includes a tape core 103, a first platen roller 105, a first feeding core 107, a first winding core 109, and a first cartridge case 111 that accommodates the above parts.

The first tape 113 is wound on the tape core 103. The first tape 113 may be, for example, one in which a release tape is releasably affixed onto the adhesive surface of a printing tape on which a print image is to be printed. The first tape 113 fed from the tape core 103 is discharged to the outside of the first cartridge case 111 via a tape exit 115 provided on the −X side lateral wall part of the first cartridge case 111. The first ink ribbon 117 is wound on the first feeding core 107. The ink ribbon 117 fed from the first feeding core 107 is wound by the first winding core 109. The first cartridge case 111 has a first head insertion hole 119 provided thereon so as to penetrate in the Z-axis. When the tape cartridge 101 is installed in the cartridge installation part 11, the printing head 15, the platen shaft 17, the first feeding shaft 19, and the first winding shaft 21 are inserted into the first head insertion hole 119, the first platen roller 105, the first feeding core 107, and the first winding core 109, respectively.

As shown in FIG. 7, the first hook engagement parts 121 are provided at two places of the lateral wall part of the first cartridge case 111. Two of the four installation hooks 31 engage the first hook engagement parts 121. The −Z side wall part of the first cartridge case 111 is provided with the first core recessed part 123 having a substantially-stepped circular recessed shape. The installation core insertion part 27 is inserted into the first core recessed part 123. Further, four first case recessed parts 125 are provided at the peripheral part of the −Z side wall part of the first cartridge case 111. The four first case recessed parts 125 are provided at positions corresponding to four of the six installation protrusion parts 29. In a state in which the tape cartridge 101 is installed in the cartridge installation part 11, a gap is formed between the first case recessed parts 125 and the installation protrusion parts 29. Note that some tape cartridges 101 are not provided with the first case recessed parts 125. In this case, the tape cartridges 101 are installed in the cartridge installation part 11 so as to be placed on the installation protrusion parts 29.

When the installation-part cover 5 is closed after the installation of the tape cartridge 101 in the cartridge installation part 11, the printing head 15 is moved toward the platen shaft 17 by a head movement mechanism not shown in the figures. Thus, the first tape 113 and the first ink ribbon 117 are held between the printing head 15 and the first platen roller 105. When the first platen roller 105 rotates in this state, the first tape 113 and the first ink ribbon 117 are fed. When the printing head 15 is heated at this time, a print image based on print data received by the tape printing apparatus 1 is printed on the first tape 113.

(Ribbon Cartridge)

Figure 8:
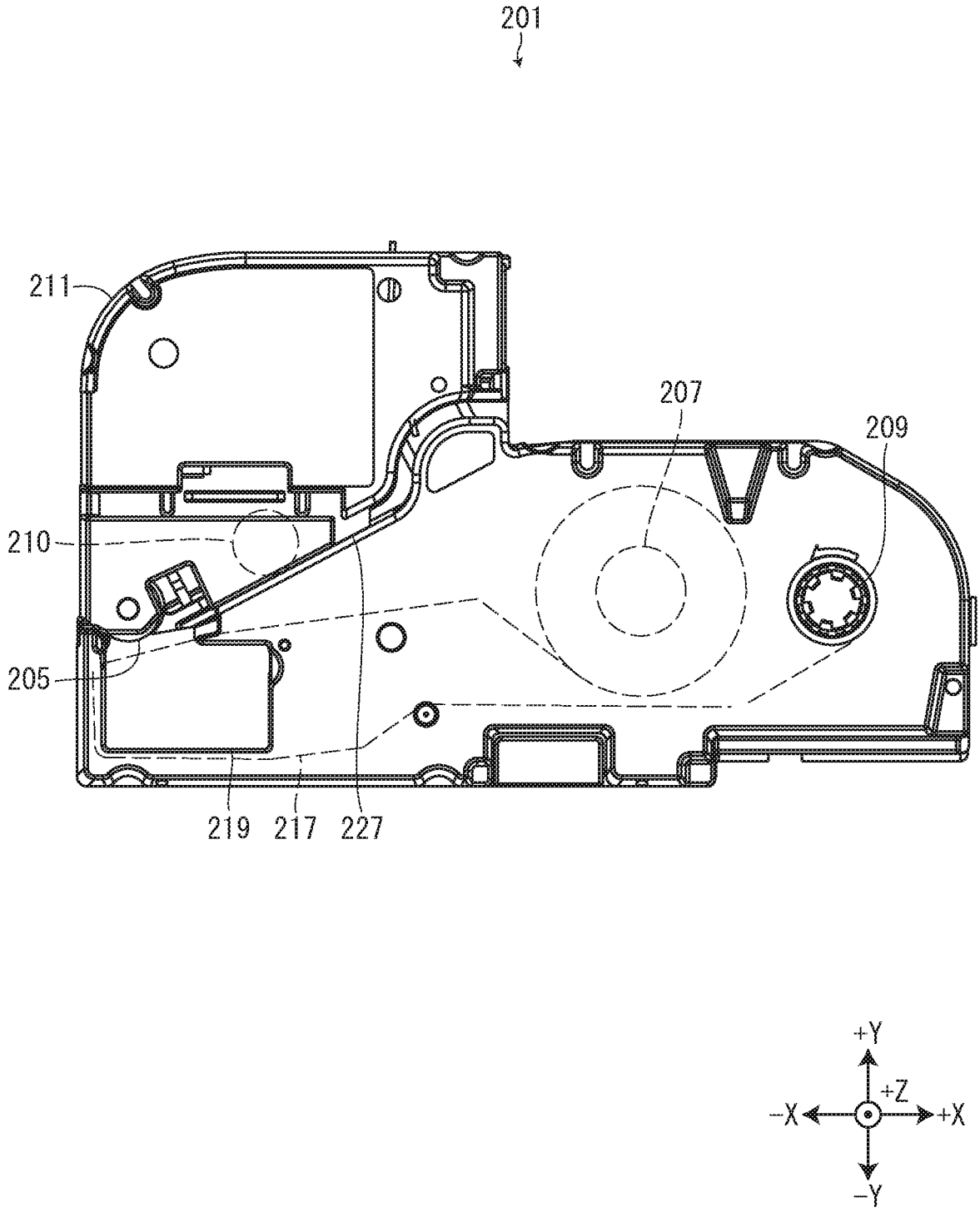
FIG. 8 is a view of the ribbon cartridge when seen from the +Z side.
Figure 9:
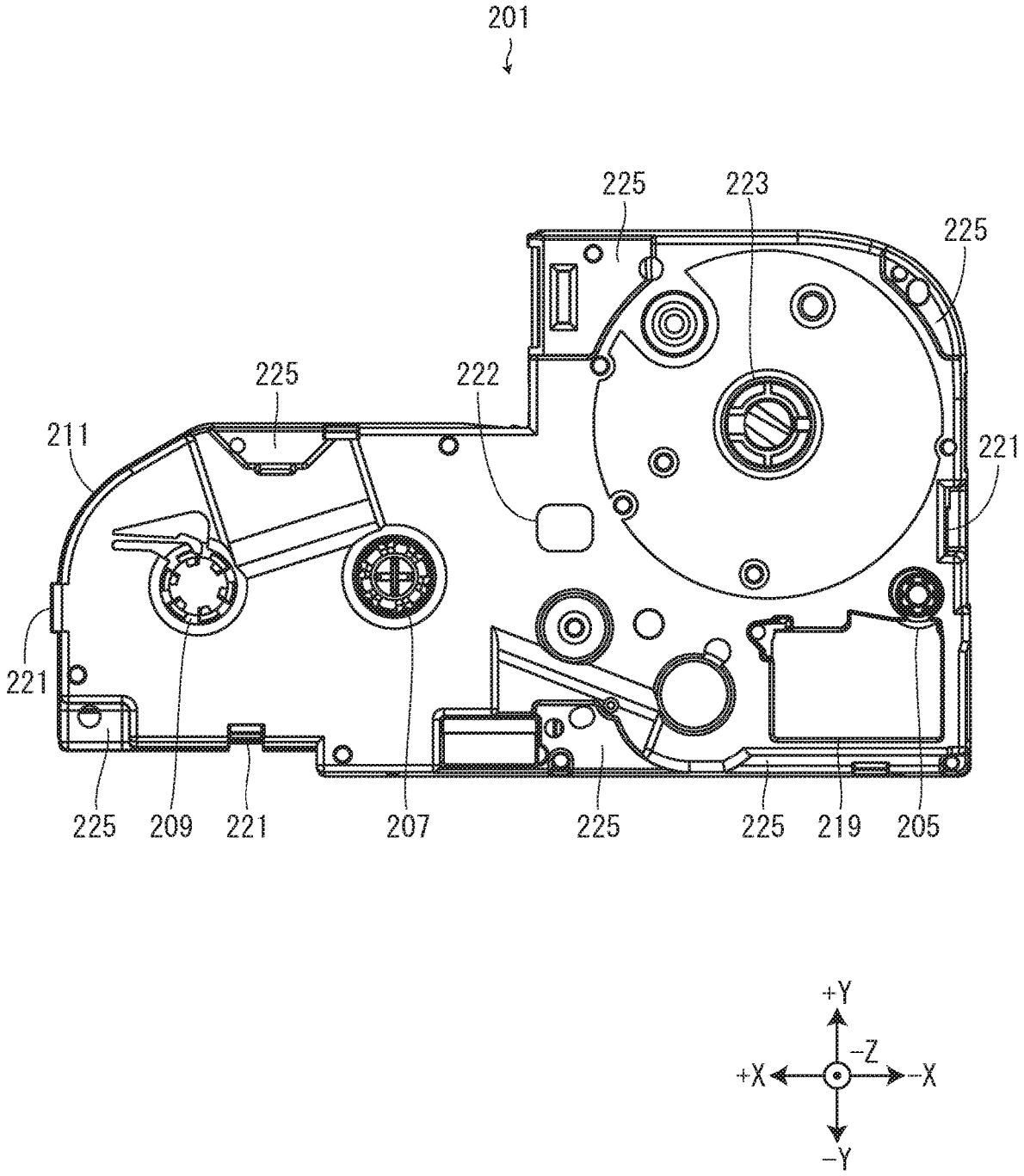
FIG. 9 is a view of the ribbon cartridge when seen from the −Z side.

As shown in FIGS. 8 and 9, the ribbon cartridge 201 includes a second platen roller 205, a second feeding core 207, a second winding core 209, a tape retention part 210, and a second cartridge case 211 that accommodates the above parts. The second ink ribbon 217 is wound on the second feeding core 207. The second ink ribbon 217 fed from the second feeding core 207 is wound by the second winding core 209. The second cartridge case 211 has a second head insertion hole 219 provided thereon so as to penetrate in the Z-axis. When the ribbon cartridge 201 is installed in the cartridge installation part 11, the printing head 15, the platen shaft 17, the second feeding shaft 23, and the second winding shaft 25 are inserted into the second head insertion hole 219, the second platen roller 205, the second feeding core 207, and the second winding core 209, respectively.

As shown in FIG. 9, the second hook engagement parts 221 are provided at three places of the lateral wall part of the second cartridge case 211. Three of the four installation hooks 31 engage the second hook engagement parts 221. Note that the −Z side wall part of the second cartridge case 211 is provided with a hook insertion hole 222 into which the one remaining installation hook 31 is inserted. The −Z side wall part of the second cartridge case 211 is provided with the second core recessed part 223 having a substantially-stepped circular recessed shape. The installation core insertion part 27 is inserted into the second core recessed part 223. Further, the peripheral part of the −Z side wall part of the second cartridge case 211 is provided with six second case recessed parts 225. The six second case recessed parts 225 are provided at positions corresponding to the six installation protrusion parts 29. In a state in which the ribbon cartridge 201 is installed in the cartridge installation part 11, a gap is formed between the second case recessed parts 225 and the installation protrusion parts 29. Note that some ribbon cartridges 201 are not provided with the second case recessed parts 225. In this case, the ribbon cartridges 201 are installed in the cartridge installation part 11 so as to be placed on the installation protrusion parts 29.

Further, the second cartridge case 211 is provided with a groove-shaped tape path 227 that is open on the +Z side. The second tape 411 introduced into the apparatus case 3 via the tape introduction port 7 is fed to the tape discharging port 9 via the tape path 227 of the ribbon cartridge 201 installed in the cartridge installation part 11.

In a state in which the ribbon cartridge 201 is not installed in the cartridge installation part 11, the tape retention part 210 holds the second tape 411 introduced into the tape path 227 in advance between the tape retention part 210 and the lateral wall part of the tape path 227 to retain the second tape 411. Thus, the second tape 411 introduced into the tape path 227 in advance is prevented from deviating from the tape path 227, for example, when the user removes the ribbon cartridge 201 from the accommodation body 301 and installs the removed ribbon cartridge 201 in the cartridge installation part 11.

When the installation-part cover 5 is closed after the installation of the ribbon cartridge 201 in the cartridge installation part 11, the printing head 15 is moved toward the platen shaft 17 by the head movement mechanism. Thus, the second tape 411 and the second ink ribbon 217 are held between the printing head 15 and the second platen roller 205. When the second platen roller 205 rotates in this state, the second tape 411 and the second ink ribbon 217 are fed. When the printing head 15 is heated at this time, a print image based on print data received by the tape printing apparatus 1 is printed on the second tape 411. Note that the tape retention part 210 releases the retention of the second tape 411 in a state in which the ribbon cartridge 201 is installed in the cartridge installation part 11. Therefore, the second tape 411 is smoothly fed without being interfered by the tape retention part 210 in the tape path 227.

(Tape Supplying Body)

Figure 10:
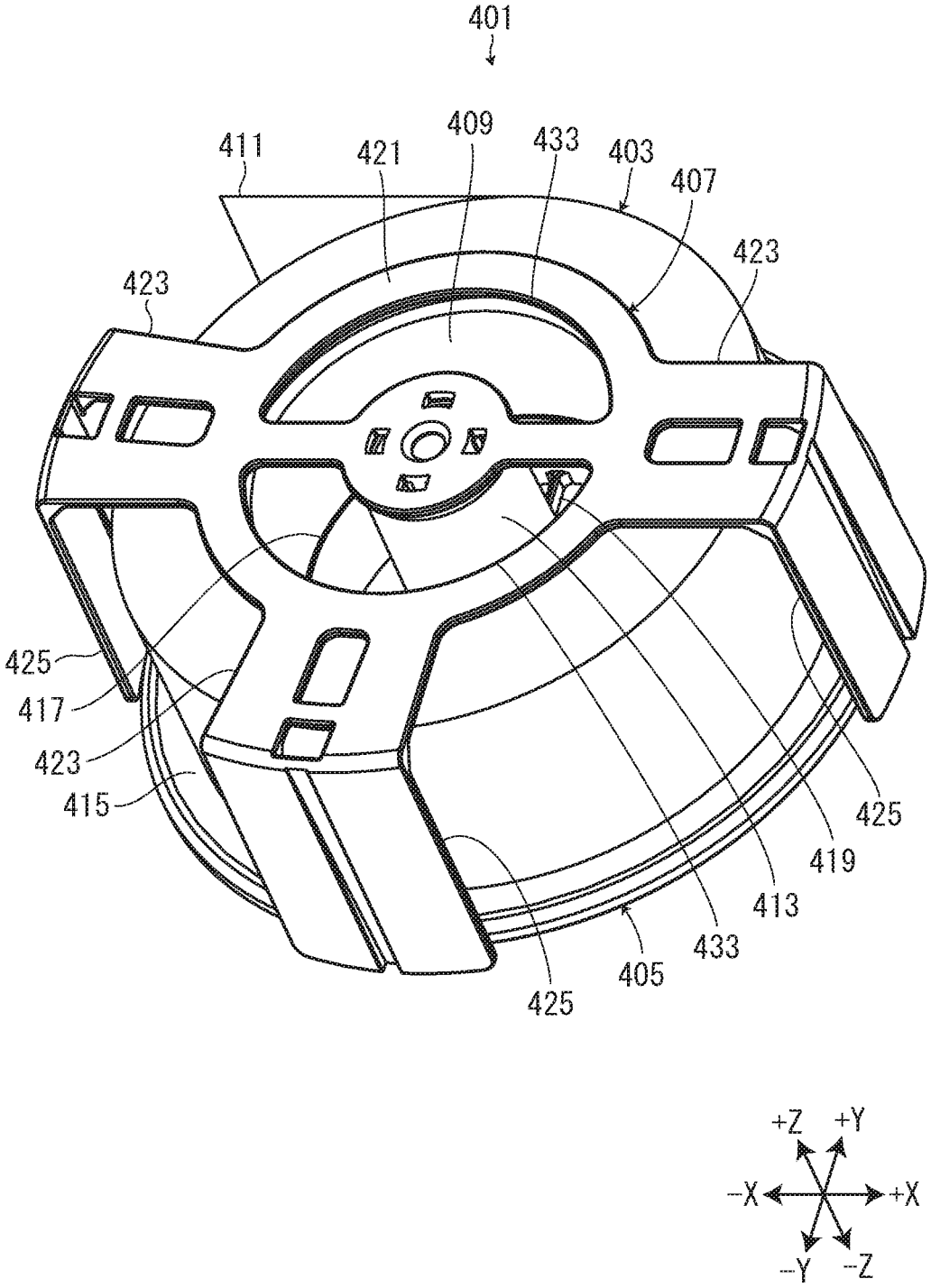
FIG. 10 is a perspective view of the tape supplying body.

As shown in FIG. 10, the tape supplying body 401 includes a tape roll 403, a first member 405, and a second member 407.

In the tape roll 403, the second tape 411 is wound on a roll core 409. Like the first tape 113, the second tape 411 may be, for example, one in which a release tape is releasably affixed onto the adhesive surface of a printing tape on which a print image is to be printed.

Figure 11:
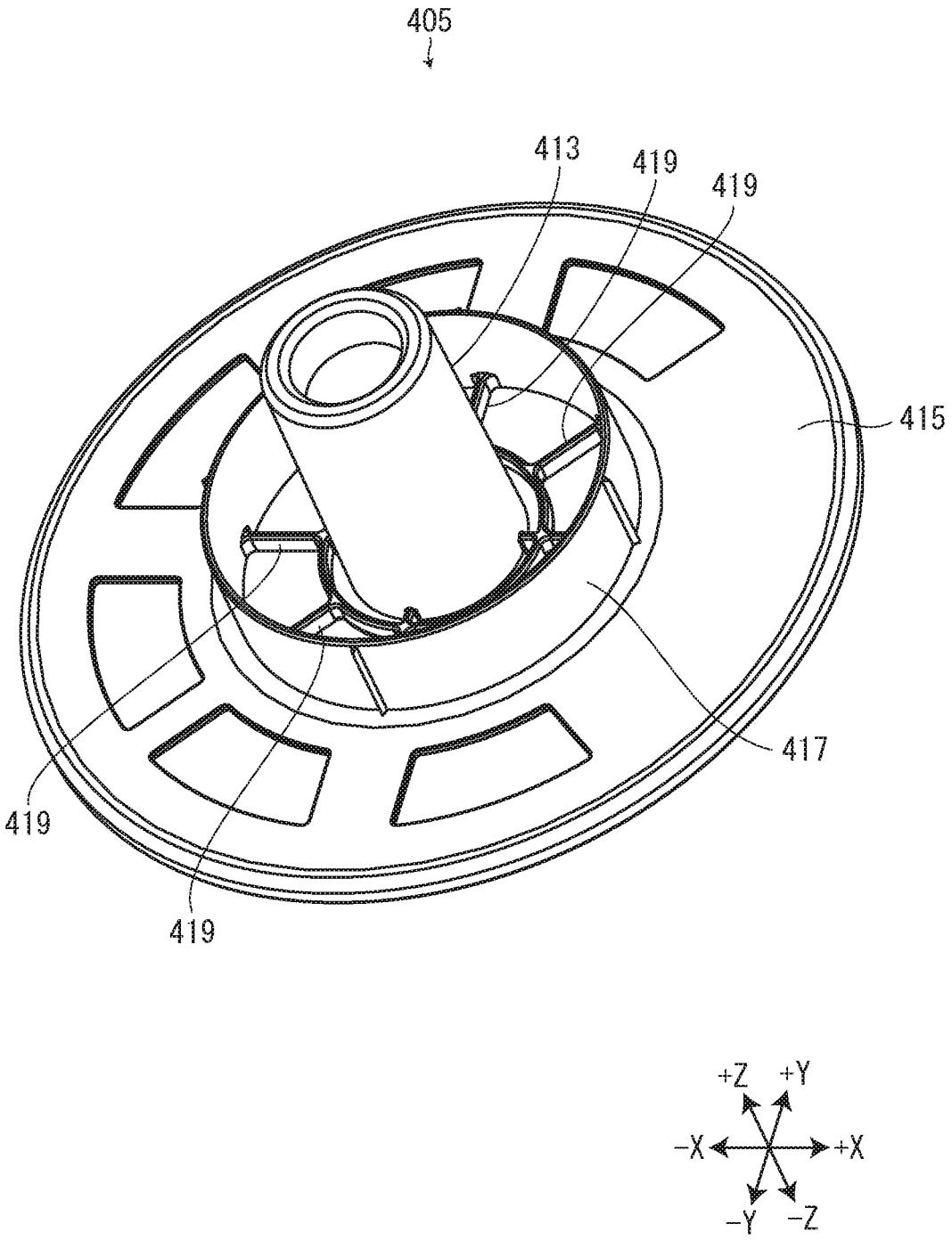
FIG. 11 is a perspective view of a first member.
Figure 12:
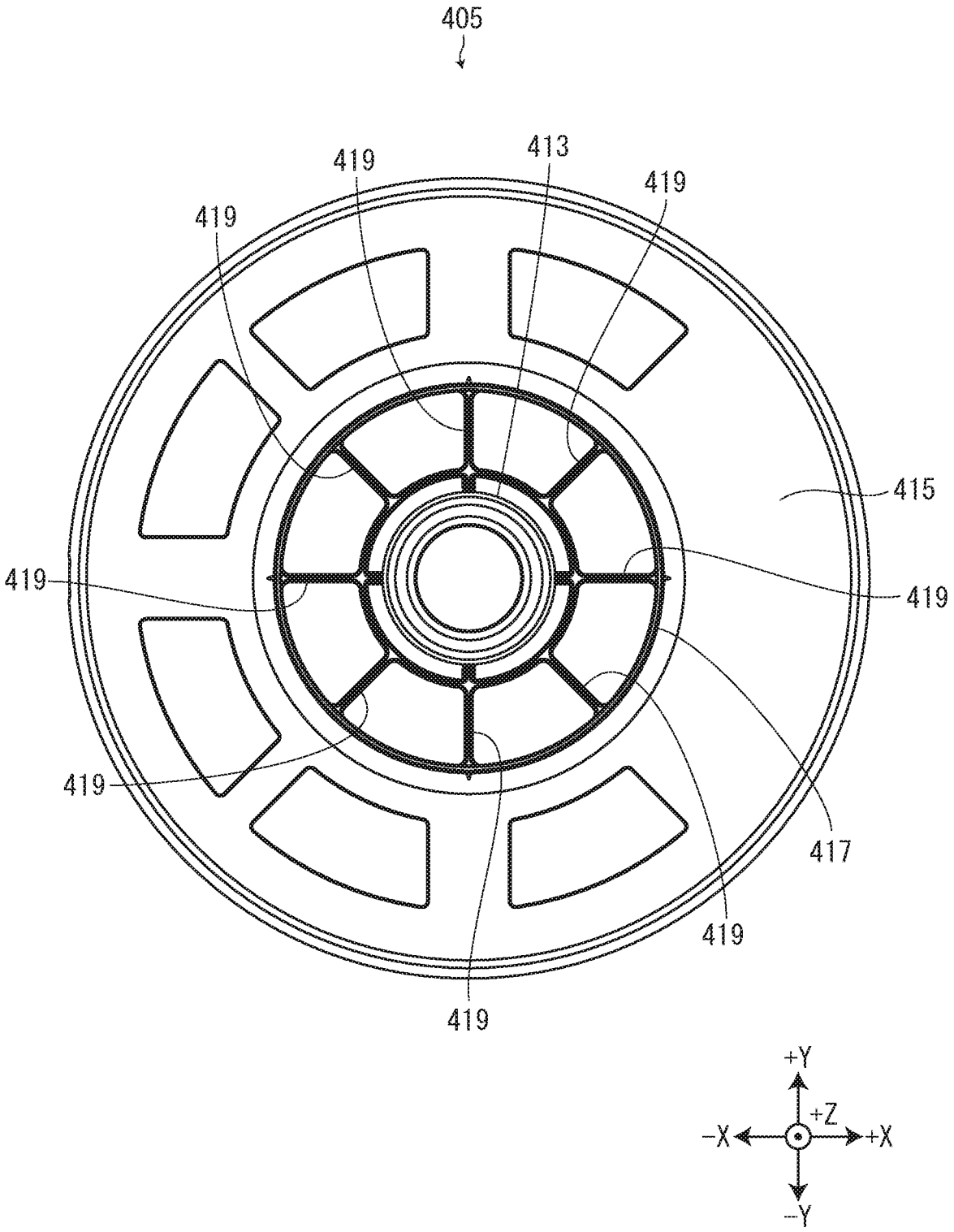
FIG. 12 is a view of the first member when seen from the +Z side.

The tape roll 403 is placed on the first member 405. As shown in FIGS. 10 to 12, the first member 405 includes a shaft part 413, a flange part 415, and a core fitting part 417.

The shaft part 413 is formed into a substantially cylindrical shape. The shaft part 413 is inserted into the roll core 409 from the −Z side so as to penetrate the roll core 409. A rotation supporting part 319 that will be described later is inserted into the shaft part 413 from the −Z side when the tape roll 403 is accommodated in the accommodation body 301.

The flange part 415 is provided in a flange shape on a radially outer side from the −Z side end of the shaft part 413. The outer peripheral part of the flange part 415 is bent toward the −Z side.

The core fitting part 417 is provided to protrude in a substantially cylindrical shape from the +Z side surface of the flange part 415. The core fitting part 417 is inserted into the roll core 409 from the −Z side and fitted into the roll core 409. That is, the −Z side end surface of the tape roll 403 is placed in a region on a radially outer side than the core fitting part 417 in the +Z side surface of the flange part 415.

Operation ribs 419 extending radially from the shaft part 413 are provided between the shaft part 413 and the core fitting part 417. When the tape roll 403 is loosened, the user rotates the first member 405 with his/her fingers hooked on the operation ribs 419. Thus, the user is allowed to rotate the tape roll 403 without touching the tape roll 403 and solve the looseness of the tape roll 403.

Figure 13:
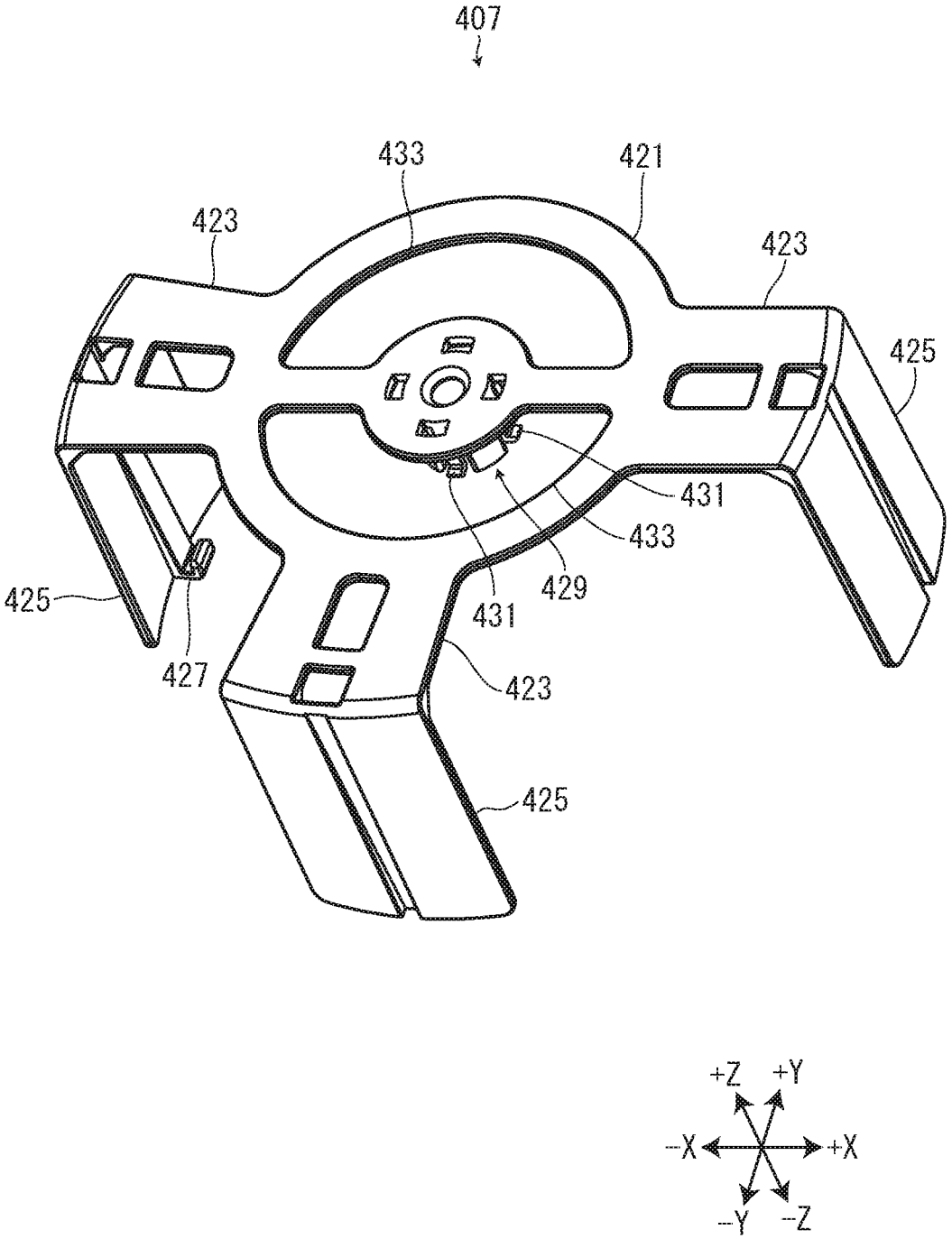
FIG. 13 is a perspective view of a second member.
Figure 14:
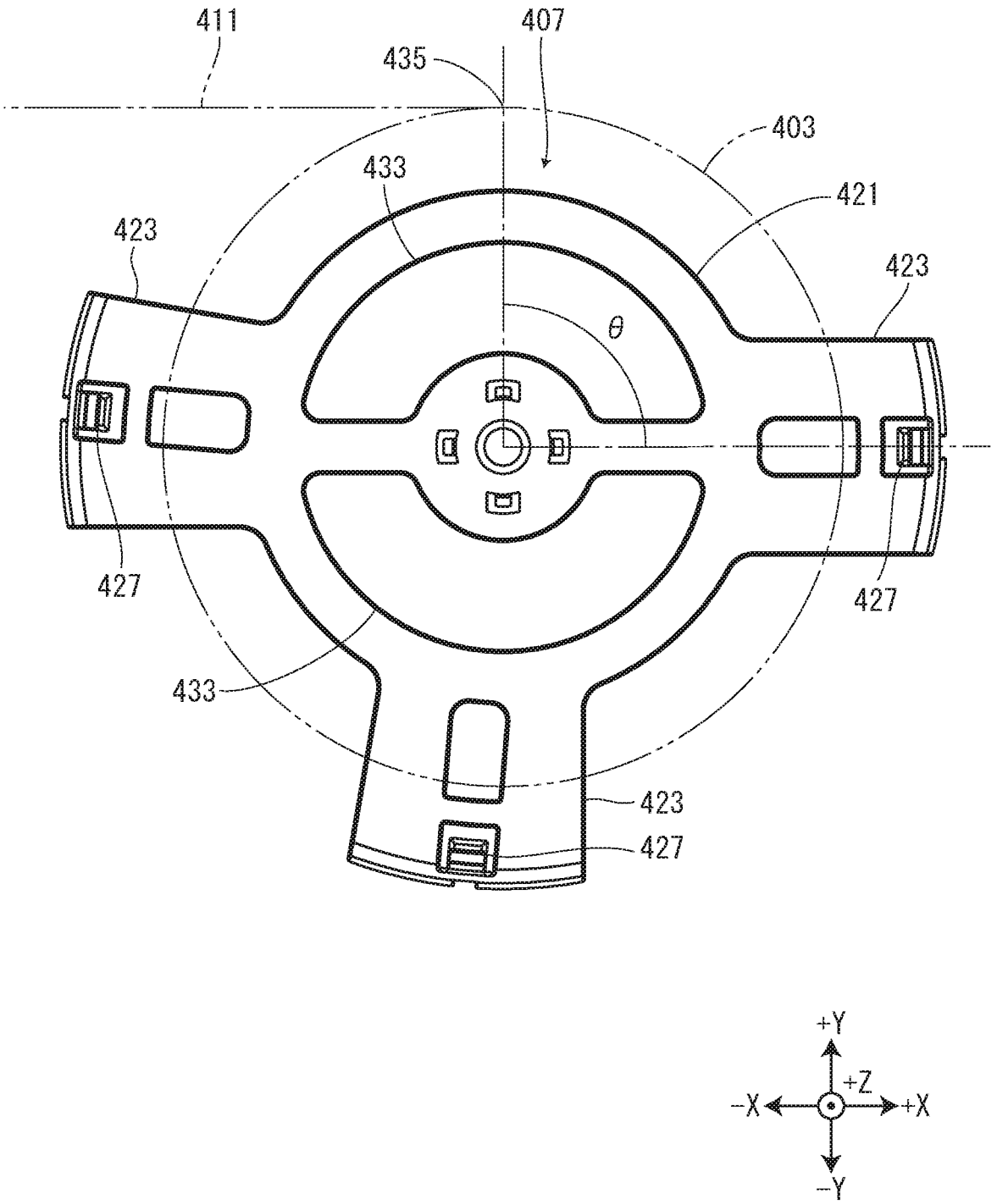
FIG. 14 is a view of the second member when seen from the +Z side.

As shown in FIGS. 10, 13, and 14, the second member 407 includes a disc part 421, three running-onto prevention parts 423, three connection parts 425, and three tape receiving parts 427.

The disc part 421 is formed into a substantially disc shape having a diameter smaller than that of the flange part 415 of the first member 405 and larger than that of the core fitting part 417. The −Z side at the center of the disc part 421 is provided with a shaft insertion part 429. The shaft insertion part 429 is provided with a plurality of hook-shaped insertion engagement parts 431. When the shaft insertion part 429 is inserted into the shaft part 413 from the +Z side, the insertion engagement parts 431 engage the +Z side end of the shaft part 413. Thus, the shaft part 413 and the shaft insertion part 429 are rotatably coupled to each other. Further, the disc part 421 is provided with two operation openings 433 formed into a substantially semicircular shape. The user may operate the operation ribs 419 via the operation openings 433.

The running-onto prevention parts 423 are provided at a upper surface of the tape roll 403, that is, on the +Z side of the tape roll 403. The running-onto prevention parts 423 extend on a radially outer side from the outer edge part of the disc part 421 and face the +Z side end surface of the tape roll 403 with a gap placed therebetween. The running-onto prevention parts 423 prevent the second tape 411 from running onto the +Z side of the tape roll 403 when the tape roll 403 is loosened. If the second tape 411 runs onto the tape roll 403, there is a possibility that a portion of the second tape 411 running onto the tape roll 403 is folded and deformed to cause the occurrence of a printing failure.

The connection parts 425 are provided on the radially outer side of the tape roll 403 and connect the running-onto prevention parts 423 and the tape receiving parts 427 to each other. The connection parts 425 extend in the Z-axis and face the outer peripheral surface of the tape roll 403.

The tape receiving parts 427 are provided at a bottom surface of the first member 405, that is, on the −Z side of the first member 405. The tape receiving parts 427 are provided to protrude on a radially inner side from the −Z side ends of the connection parts 425. The tip ends of the tape receiving parts 427 are bent toward +Z side in a hooked shape. Between the hooked ends and the connection parts 425, the outer edge part of the flange part 415 bent toward the −Z side is positioned. When the tape roll 403 is loosened, the tape receiving parts 427 receive the second tape 411 dropping from the first member 405 and prevent the second tape 411 from further dropping from the first member 405.

(Accommodation Body)

Figure 15:
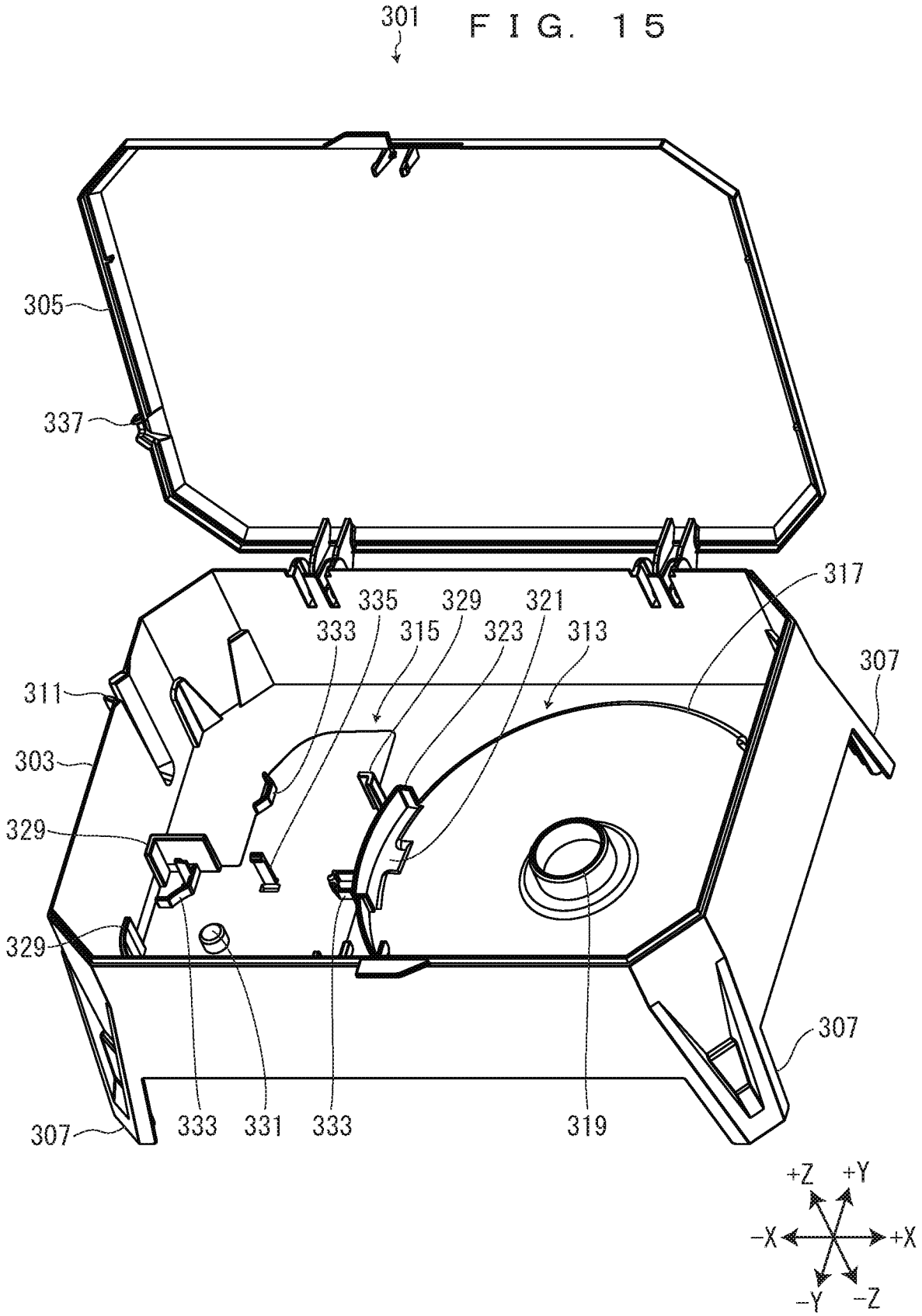
FIG. 15 is a perspective view of the accommodation body.
Figure 16:
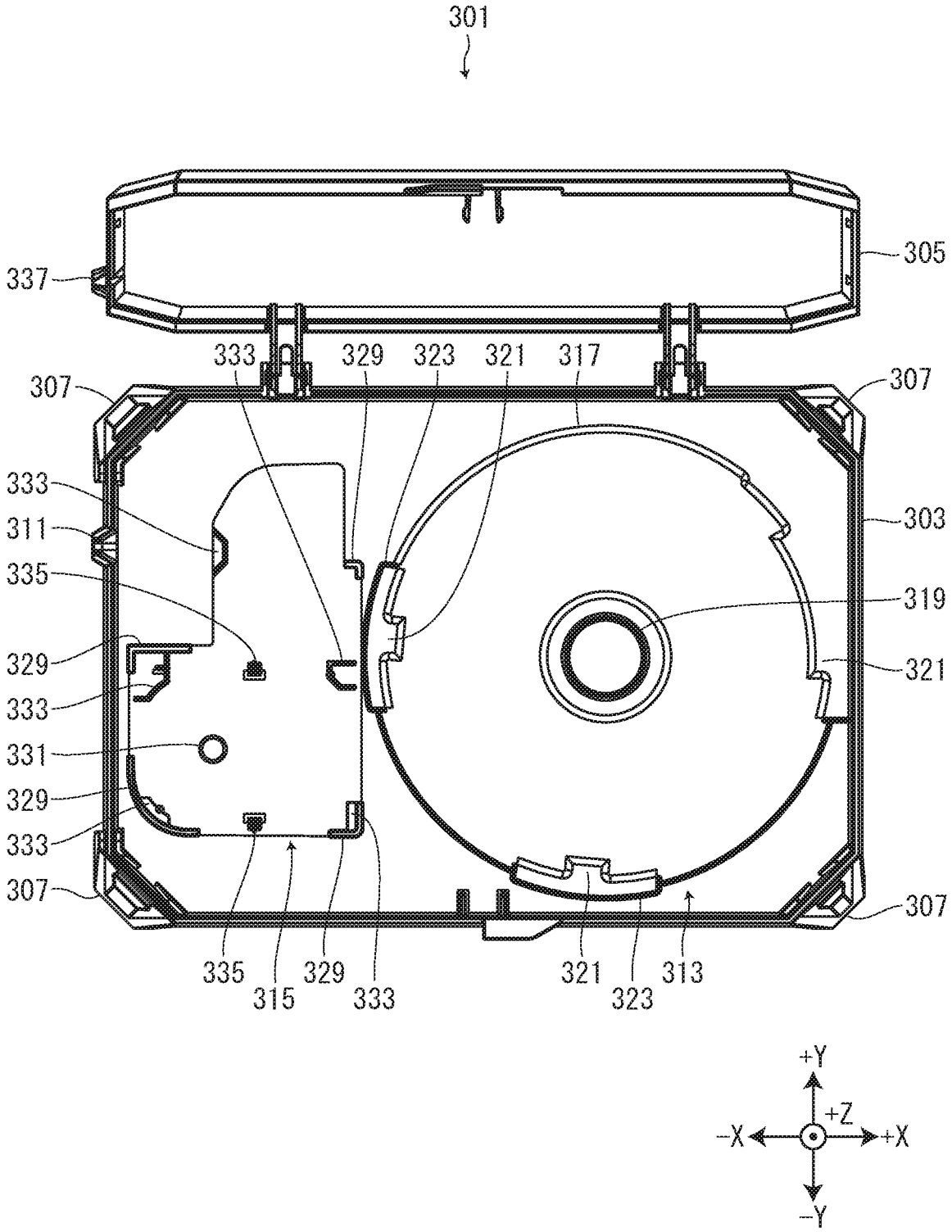
FIG. 16 is a view of the accommodation body when seen from the +Z side.

As shown in FIGS. 15 and 16, the accommodation body 301 includes an accommodation body part 303, an accommodation lid part 305, and four accommodation leg parts 307.

The accommodation body part 303 is formed into a substantially rectangular shape that is open on the +Z side. The −X side wall part of the accommodation body part 303 is provided with a body-part discharge port 311. The body-part discharge port 311 is combined with a lid discharge port 337 that will be described later to constitute a tape discharge port 309 (see FIG. 1) from which the second tape 411 is to be discharged. A supplying-body accommodation part 313 is provided in a region substantially two-thirds of the +X side region of the accommodation body part 303, and a cartridge accommodation part 315 is provided in a region substantially one-third of the −X side region of the accommodation body part 303. That is, the cartridge accommodation part 315 is provided between the supplying-body accommodation part 313 and the body-part discharge port 311.

The tape supplying body 401 is accommodated in the supplying-body accommodation part 313. The supplying-body accommodation part 313 is an example of a □tape roll accommodation part.□ The supplying-body accommodation part 313 is provided with a circular base part 317, a rotation supporting part 319, three outer-edge recessed parts 321, and two outer-edge protrusion parts 323.

The circular base part 317 is formed into a circular base shape having substantially the same diameter as that of the first member 405 and protrudes toward the +Z side from the bottom surface of the supplying-body accommodation part 313.

The rotation supporting part 319 is provided to further protrude toward the +Z side from the center of the circular base part 317 and formed into a substantially cylindrical shape. When the tape supplying body 401 is installed in the accommodation body 301, the rotation supporting part 319 is inserted into the shaft part 413 of the first member 405. The rotation supporting part 319 rotatably supports the first member 405 and the tape roll 403 placed on the first member 405.

The three outer edge recessed parts 321 are provided at three places of the outer edge part of the circular base part 317, that is, at the +X side outer edge part, the −X side outer edge part, and the −Y side outer edge part of the circular base part 317. The three outer edge recessed parts 321 are provided at positions corresponding to the tape receiving parts 427 of the second member 407. Note that the outer edge recessed part 321 provided on the +X side among the three outer edge recessed parts 321 is formed to be longer than the other two outer edge recessed parts 321 in a circumferential direction so as to be capable of corresponding to a tape receiving part 427 of a second member 407 of a modified example that will be described later.

The two outer edge protrusion parts 323 are provided on the radially outer side of two of the three outer edge recessed parts 321, that is, the outer edge recessed part 321 provided on the −X side and the outer edge recessed part 321 provided on the −Y side. The outer edge protrusion parts 323 are formed into a substantially circular shape when seen from the +Z side and have both their circumferential ends bent on a radially inner side.

Figure 17:
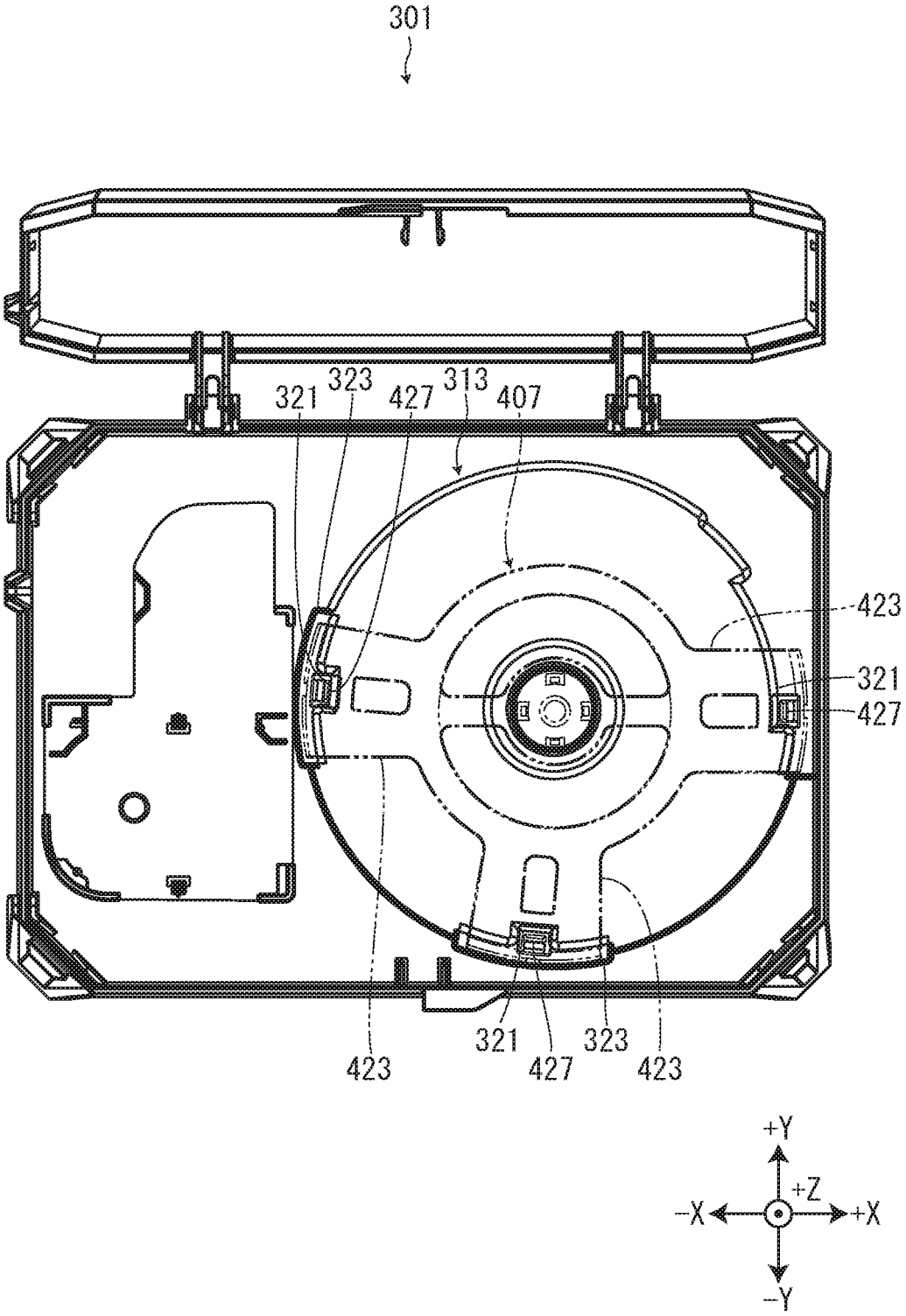
FIG. 17 is a view of the accommodation body and the second member when seen from the +Z side.

As shown in FIG. 17, the tape supplying body 401 is installed in the supplying-body accommodation part 313 configured as described above so that the three tape receiving parts 427 correspond to the three outer edge recessed parts 321. That is, the direction of the second member 407 in the circumferential direction of the second member 407 is determined by the outer edge recessed parts 321. Note that in FIG. 17, only the second member 407 of the tape supplying body 401 installed in the supplying-body accommodation part 313 is indicated by two-dot chain lines for the convenience of illustration.

In this state, the connection parts 425 are positioned on the radially inner side of the outer edge protrusion parts 323. Therefore, even if the second member 407 attempts to rotate, the connection parts 425 abut with any of both the circumferential ends of the outer edge protrusion parts 323. Therefore, the second member 407 is not allowed to further rotate. Thus, the outer edge protrusion parts 323 function as □rotation prevention parts□ that prevent the rotation of the second member 407. Note that since the shaft part 413 of the first member 405 and the shaft insertion part 429 of the second member 407 are rotatably coupled to each other as described above, the first member 405 is rotatable even in a state in which the rotation of the second member 407 is prevented by the outer edge protrusion parts 323.

When the second platen roller 205 rotates and the second tape 411 is fed from the tape roll 403 in the tape printing apparatus 1, the tape roll 403 and the first member 405 integrally rotate. Here, if the second member 407 is configured to rotate together with the tape roll 403 and the first member 405 unlike the present embodiment, the connection parts 425 get stuck on the second tape 411 fed from the tape roll 403. On the other hand, the rotation of the second member 407 is prevented by the outer edge protrusion parts 323 when the tape roll 403 and the first member 405 integrally rotate according to the present embodiment. Accordingly, it is possible to prevent the connection parts 425 of the second member 407 from getting stuck on the second tape 411 fed from the tape roll 403.

The tape cartridge 101 and the ribbon cartridge 201 are alternatively accommodated in the cartridge accommodation part 315. Therefore, compared with a configuration in which an accommodation space for the tape cartridge 101 and an accommodation space for the ribbon cartridge 201 are separately provided, it is possible to achieve the miniaturization of the accommodation body 301. Note that the tape cartridge 101 is installed in the cartridge installation part 11 with its longitudinal direction parallel to the Y-axis (see FIG. 2), while the tape cartridge 101 is accommodated in the cartridge accommodation part 315 with its longitudinal direction parallel to the X-axis (see FIG. 3). Further, the ribbon cartridge 201 is installed in the cartridge installation part 11 with its longitudinal direction parallel to the X-axis (see FIG. 3), while the ribbon cartridge 201 is accommodated in the cartridge accommodation part 315 with its longitudinal direction parallel to the Y-axis (see FIG. 2).

The cartridge accommodation part 315 is provided with four positioning protrusion parts 329, an accommodation core insertion part 331, five accommodation protrusion parts 333, and two accommodation hooks 335. The four positioning protrusion parts 329 are provided at the peripheral part of the cartridge accommodation part 315 and engage the lateral wall part of the first cartridge case 111 or the lateral wall part of the second cartridge case 211 to position the tape cartridge 101 or the ribbon cartridge 201.

The accommodation core insertion part 331 is formed into a substantially columnar shape and inserted into the first core recessed part 123 or the second core recessed part 223. The five accommodation protrusion parts 333 are provided at the peripheral part of the cartridge accommodation part 315. In a state in which the tape cartridge 101 or the ribbon cartridge 201 is accommodated in the cartridge accommodation part 315, a gap is formed between the first case recessed parts 125 or the second case recessed parts 225 and the accommodation protrusion parts 333. Note that the tape cartridge 101 not provided with the first case recessed parts 125 or the ribbon cartridge 201 not provided with the second case recessed parts 225 is placed on the accommodation protrusion parts 333.

The two accommodation hooks 335 engage the first hook engagement parts 121 or the second hook engagement parts 221 to retain the accommodated tape cartridge 101 or the ribbon cartridge 201. Thus, when the user carries the accommodation body 301, the accommodated tape cartridge 101 or the ribbon cartridge 201 is prevented from moving inside the accommodation body 301. As a result, the breakage of the second tape 411 caused when the tape cartridge 101 or the ribbon cartridge 201 abuts with the tape roll 403 is prevented. The accommodation hooks 335 are an example of a □cartridge retention part.□ Note that when the ribbon cartridge 201 is accommodated in the cartridge accommodation part 315, one of the two accommodation hooks 335 is inserted into the hook insertion hole 222.

The positioning protrusion parts 329, the accommodation core insertion part 331, the accommodation protrusion parts 333, and the accommodation hooks 335 are provided so as not to abut with the second tape 411 fed from the tape roll 403 to the tape discharge port 309 regardless of whether a tape feeding path changes with a change in the winding diameter of the tape roll 403. Thus, it is possible to satisfactorily feed the second tape 411.

The accommodation lid part 305 is used to open and close the +Z side opening part of the accommodation body part 303. The accommodation lid part 305 is opened when the tape supplying body 401 and the tape cartridge 101 or the ribbon cartridge 201 are put in or taken out from the accommodation body part 303. Like the installation-part cover 5 turnably attached to the +Y side of the apparatus case 3 in the tape printing apparatus 1, the accommodation lid part 305 has a turning shaft parallel to the X-axis and is turnably attached to the +Y side of the accommodation body part 303. Therefore, as shown in FIGS. 2 and 3, the installation-part cover 5 and the accommodation lid part 305 are opened in the same direction in a state in which the tape printing apparatus 1 and the accommodation body 301 are coupled to each other. Thus, it is possible to easily perform the opening/closing operation of the installation-part cover 5 or the accommodation lid part 305 and possible to save installation spaces for the tape printing apparatus 1 and the accommodation body 301.

The −X side wall part of the accommodation lid part 305 is provided with a lid discharge port 337. When the accommodation lid part 305 is closed, the lid discharge port 337 is combined with the body-part discharge port 311 to constitute the tape discharge port 309.

The four accommodation leg parts 307 are provided at the −Z side four corners of the accommodation body part 303 to support the accommodation body part 303. Note that the −Z side ends of the accommodation leg parts 307 expand outward. Therefore, it is possible to stack a plurality of accommodation bodies 301 with each other in such a manner that the accommodation body part 303 of one accommodation body 301 enters the inner side of the four accommodation leg parts 307 of another accommodation body 301.

Here, in the ribbon cartridge 201 accommodated in the cartridge accommodation part 315, the second tape 411 fed from the tape supplying body 401 accommodated in the supplying-body accommodation part 313 is retained by the tape retention part 210. Therefore, by removing the ribbon cartridge 201 retaining the second tape 411 from the accommodation body 301 and installing the removed ribbon cartridge 201 in the cartridge installation part 11 of the tape printing apparatus 1, the user is allowed to install the second tape 411 and the ribbon cartridge 201 in the tape printing apparatus 1.

Further, as described above, the cartridge accommodation part 315 is provided between the supplying-body accommodation part 313 and the body-part discharge port 311. Therefore, in a state in which the second tape 411 fed from the tape supplying body 401 accommodated in the supplying-body accommodation part 313 is retained by the ribbon cartridge 201 accommodated in the cartridge accommodation part 315, the user is allowed to install the ribbon cartridge 201 in the cartridge installation part 11 without changing the feeding direction of the second tape 411. Further, since the cartridge accommodation part 315 is provided between the supplying-body accommodation part 313 and the body-part discharge port 311, a distance from the supplying-body accommodation part 313 to the body-part discharge port 311 is increased. Therefore, when the ribbon cartridge 201 is taken out from the cartridge accommodation part 315 to the +Z side in order to be installed in the cartridge installation part 11, the second tape 411 is fed from the tape supplying body 401 accommodated in the supplying-body accommodation part 313 at an angle nearly parallel to the bottom surface of the accommodation body part 303. Accordingly, the second tape 411 is prevented from getting stuck on the running-onto prevention parts 423.

In the present embodiment, the tape roll 403 supported by the rotation supporting part 319 is positioned deeper on the −Z side than the second tape 411 fed to the tape printing apparatus 1. Therefore, a force is applied to the second tape 411 fed from the tape roll 403 on the +Z side between the tape roll 403 and the tape printing apparatus 1. Then, the fed second tape 411 is allowed to escape to the +Z side since a gap is formed between the +Z side end surface of the tape roll 403 and the running-onto prevention parts 423 of the first member 405 as described above. Therefore, the occurrence of distortion in the fed second tape 411 is prevented. Accordingly, it is possible to prevent the occurrence of a conveyance failure in the fed second tape 411 in the tape printing apparatus 1. Note that the rotation supporting part 319 only needs not to be positioned deeper on the +Z side than the second tape 411 introduced into the tape path 227 of the ribbon cartridge 201 installed in the cartridge installation part 11. In other words, the rotation supporting part 319 and the second tape 411 introduced into the tape path 227 of the ribbon cartridge 201 installed in the cartridge installation part 11 may be positioned at the same level in the +Z direction.

(Coupling Member)

Figure 18:
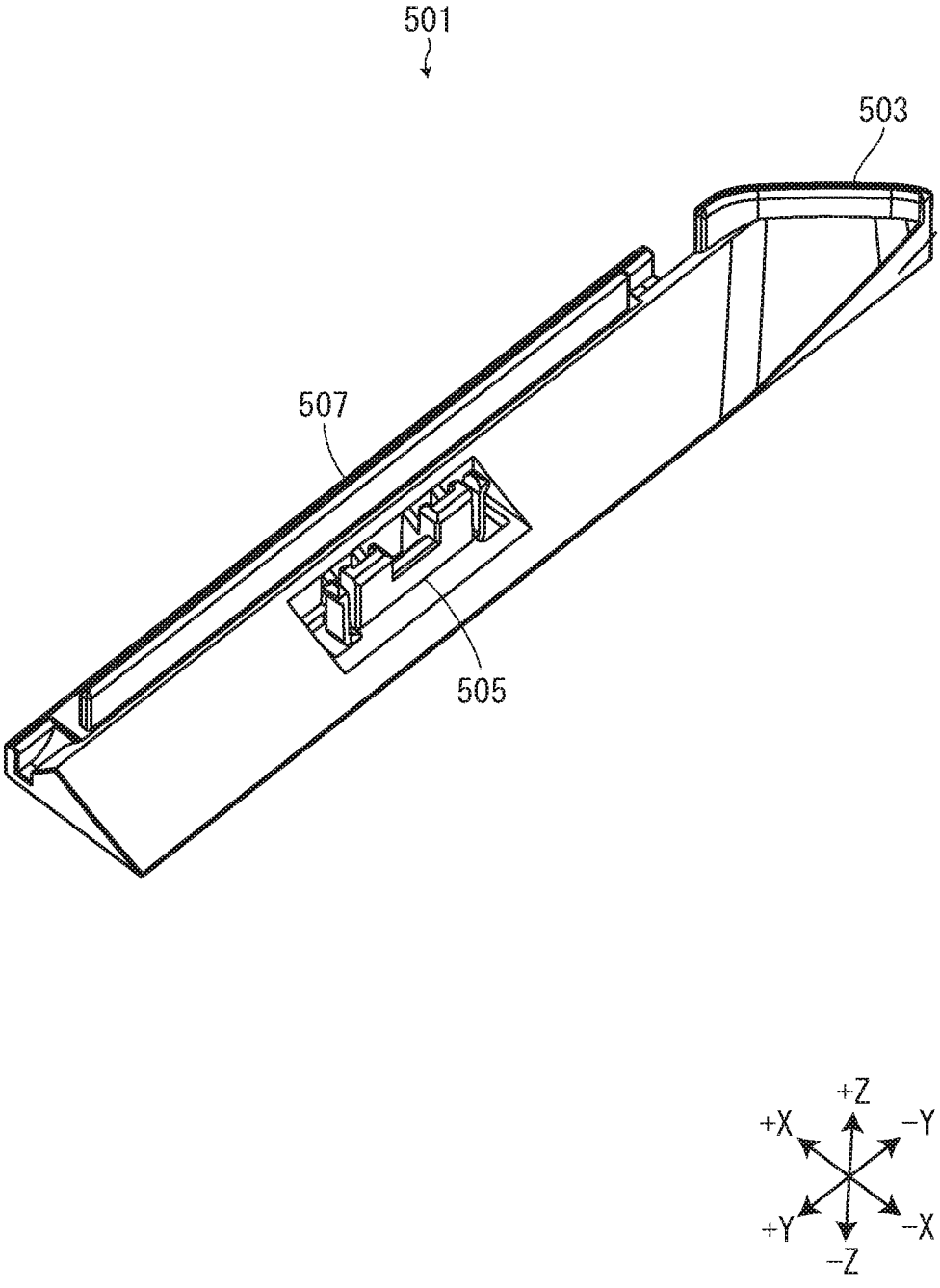
FIG. 18 is a perspective view of a coupling member.

The coupling member 501 couples the tape printing apparatus 1 and the accommodation body 301 to each other. As shown in FIG. 18, the coupling member 501 includes a coupling first engagement part 503, the coupling second engagement part 505, and a coupling third engagement part 507. The coupling first engagement part 503 engages the +X side, −Y side, and −Z side angular parts of the apparatus case 3. The coupling second engagement part 505 engages the printing-body engagement part 33. The coupling third engagement part 507 engages the prescribed place of the −X side wall part of the accommodation body 301. When the tape printing apparatus 1 and the accommodation body 301 are coupled to each other via the coupling member 501, the accommodation body 301 is positioned with respect to the tape printing apparatus 1. Accordingly, it is possible to satisfactorily feed the second tape 411 from the tape supplying body 401 accommodated in the accommodation body 301 to the tape printing apparatus 1.

(Tape Supplying Body Set)

The tape supplying body set including a first tape supplying body 401 and a second tape supplying body 401 will be described. The first tape supplying body 401 includes a tape roll 403 on which a second tape 411 having a narrow width is wound. The second tape supplying body 401 includes a tape roll 403 on which a second tape 411 having a wide width is wound.

Figure 19:
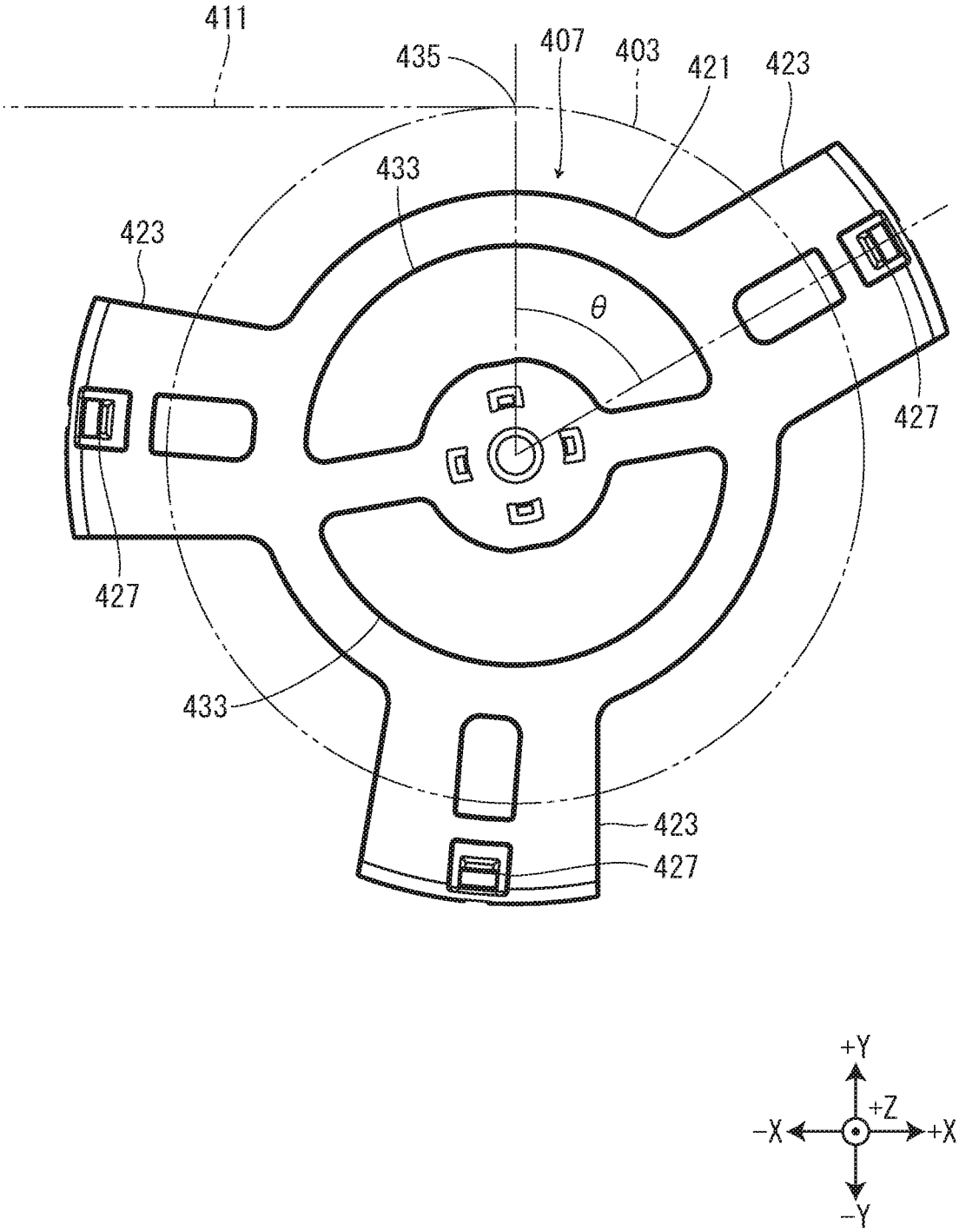
FIG. 19 is a view of a second member according to a modified example when seen from the +Z side.

Here, when the second tape 411 has a narrow width, the second tape 411 is liable to run onto the tape roll 403. Further, when the ribbon cartridge 201 is removed from the cartridge accommodation part 315 to the +Z side in order to be installed in the cartridge installation part 11, the second tape 411 fed from the tape roll 403 is not liable to get stuck on the running-onto prevention parts 423. Therefore, as shown in FIG. 19, one +X side running-onto prevention part 423 among the three running-onto prevention parts 423 of the first tape supplying body 401 is provided at a place relatively close to a feeding start position 435 of the second tape 411 in the tape roll 403. Note that an angle θ formed by the running-onto prevention part 423 with respect to an imaginary line connecting the feeding start position 435 of the second tape 411 in the tape roll 403 and the center of the tape roll 403 to each other is, for example, approximately 60°. Note that a case in which the second tape 411 has a narrow width refers to, for example, a case in which the second tape 411 has a width of 4 mm or more and less than 19 mm.

On the other hand, when the second tape 411 has a wide width, the second tape 411 is not liable to run onto the tape roll 403. Further, when the ribbon cartridge 201 is removed from the cartridge accommodation part 315 to the +Z side in order to be installed in the cartridge installation part 11, the second tape 411 fed from the tape roll 403 is liable to get stuck on the running-onto prevention parts 423. Therefore, as shown in FIG. 14, one +X side running-onto prevention part 423 among the three running-onto prevention parts 423 of the first tape supplying body 401 is provided at a place relatively far from the feeding start position 435 of the second tape 411 in the tape roll 403. Note that an angle θ formed by the running-onto prevention part 423 with respect to an imaginary line connecting the feeding start position 435 of the second tape 411 in the tape roll 403 and the center of the tape roll 403 to each other is, for example, approximately 90°. Note that a case in which the second tape 411 has a wide width refers to, for example, a case in which the second tape 411 has a width of 19 mm or more.

Thus, the position of the running-onto prevention part 423 with respect to the feeding start position 435 of the second tape 411 is changed according to the width of the second tape 411, whereby it is possible to solve a problem that the second tape 411 having a narrow width is liable to run onto the tape roll 403 and the second tape 411 having a wide width is liable to get stuck on the running-onto prevention parts 423.

As described above, the ribbon cartridge 201 is accommodated together with the tape roll 403 according to the accommodation body 301 of the present embodiment. Therefore, it is possible to accommodate the ribbon cartridge 201 while retaining the second tape 411 fed from the tape roll 403. Accordingly, the user is allowed to install the second tape 411 and the ribbon cartridge 201 in the tape printing apparatus 1 by performing a simple operation to remove the ribbon cartridge 201 retaining the second tape 411 from the accommodation body 301 and install the removed ribbon cartridge 201 in the tape printing apparatus 1.

OTHER MODIFIED EXAMPLES

The disclosed embodiment is not limited to the above embodiment and may, of course, employ various configurations without departing from its spirit. For example, the above embodiment may be modified into the following modes.

The □rotation prevention parts□ are not limited to the configuration of the outer edge protrusion parts 323 that engage the connection parts 425 to prevent the rotation of the second member 407. For example, the □rotation prevention parts□ may be configured to engage the running-onto prevention parts 423 to prevent the rotation of the second member 407. Further, the □rotation prevention parts□ may be configured to have a cross-sectional shape complementary with a non-circular hole provided on the shaft insertion part 429 and configured to be inserted into the hole to prevent the rotation of the second member 407.

The tape printing apparatus 1 and the accommodation body 301 may be configured to be directly coupled to each other without the coupling member 501. Further, the tape printing apparatus 1 and the accommodation body 301 may be configured to be integrated with each other.

Further, configurations in which the above embodiment and the modified examples are combined with each other may be employed.

(Supplementary Note)

Hereinafter, an accommodation body and a tape printing system will be supplementary noted.

An accommodation body includes: a tape roll accommodation part in which a tape roll on which a tape to be fed to a tape printing apparatus is wound is accommodated; a wall part that is provided with a tape discharge port from which the tape fed from the tape roll is to be discharged; and a cartridge accommodation part in which a ribbon cartridge that has an ink ribbon and is to be installed in the tape printing apparatus while retaining the tape fed from the tape roll is accommodated.

According to the configuration, the ribbon cartridge is accommodated together with the tape roll. Therefore, it is possible to accommodate the ribbon cartridge while retaining the tape fed from the tape roll. Accordingly, the user is allowed to install the tape and the ribbon cartridge in the tape printing apparatus by performing a simple operation to remove the ribbon cartridge retaining the tape from the accommodation body and install the removed ribbon cartridge in the tape printing apparatus.

In this case, the cartridge accommodation part is preferably provided between the tape roll accommodation part and the tape discharge port.

According to the configuration, the user is allowed to install the ribbon cartridge in the tape printing apparatus without changing the feeding direction of the tape fed from the tape roll accommodated in the tape roll accommodation part from a state in which the tape is retained by the ribbon cartridge accommodated in the cartridge accommodation part.

In this case, a tape supplying body including the tape roll, a first member on which one end surface of the tape roll is placed, and a second member is preferably accommodated in the tape roll accommodation part, the second member preferably has a running-onto prevention part that is provided at other end surface of the tape roll and prevents the tape from running onto the tape roll, a tape receiving part that is provided at a bottom surface of the first member and receives the tape dropping from the first member, and a connection part that is provided on a radially outer side of the tape roll and connects the running-onto prevention part and the tape receiving part to each other, and the tape roll accommodation part is preferably provided with a rotation supporting part that rotatably supports the first member and a rotation prevention part that prevents rotation of the second member when the tape is fed from the tape roll and the tape roll and the first member integrally rotate with each other.

According to the configuration, the rotation of the second member is prevented by the rotation prevention part when the tape roll and the first member integrally rotate with each other. Accordingly, it is possible to prevent the connection part of the second member from getting stuck on the tape fed from the tape roll.

In this case, the rotation prevention part preferably engages the connection part to prevent rotation of the second member.

According to the configuration, it is possible to prevent the rotation of the second member using the connection part.

In this case, the tape roll accommodation part is preferably provided with a recessed part that is provided corresponding to the tape receiving part and determines a direction of the second member in a circumferential direction of the second member.

According to the configuration, it is possible to accommodate the tape supplying body in the tape roll accommodation part in a state in which the direction of the second member is determined in the circumferential direction of the second member.

In this case, the cartridge accommodation part is preferably provided with a cartridge retention part that retains the ribbon cartridge.

According to the configuration, the accommodated ribbon cartridge is prevented from moving inside the accommodation body when the user carries the accommodation body.

A tape printing system includes: a tape printing apparatus; and an accommodation body including a tape roll accommodation part in which a tape roll on which a tape to be fed to the tape printing apparatus is wound is accommodated, a wall part on which a tape discharge port from which the tape fed from the tape roll is to be discharged is provided, and a cartridge accommodation part in which a ribbon cartridge that has an ink ribbon and is to be installed in the tape printing apparatus is accommodated, the ribbon cartridge being capable of retaining the tape fed from the tape roll.

According to the configuration, it is possible to accommodate the ribbon cartridge while retaining the tape fed from the tape roll. Therefore, the user is allowed to install the tape and the ribbon cartridge in the tape printing apparatus by performing a simple operation to remove the ribbon cartridge retaining the tape from the accommodation body and install the removed ribbon cartridge in the tape printing apparatus.

In this case, the tape printing system preferably further includes a coupling member that couples the tape printing apparatus and the accommodation body to each other.

According to the configuration, the accommodation body is positioned with respect to the tape printing apparatus when the tape printing apparatus and the accommodation body are coupled to each other via the coupling member. Accordingly, it is possible to satisfactorily feed the tape from the tape roll accommodated in the accommodation body to the tape printing apparatus.

What is claimed is:

1. An accommodation body comprising:

an accommodation body part;

an accommodation lid part located on a first side of the accommodation body part; and accommodation leg parts that support the accommodation body part, the accommodation leg parts being located on a second side of the accommodation body part opposite to the first side and extending away from the second side in a direction orthogonal to a surface of the second side, the accommodation body part including:

a tape roll accommodation part in which a tape roll on which a tape to be fed to a tape printing apparatus is wound is accommodated;

a wall part that is provided with a tape discharge port from which the tape fed from the tape roll is to be discharged; and a cartridge accommodation part in which a ribbon cartridge that has an ink ribbon and is to be installed in the tape printing apparatus while retaining the tape fed from the tape roll is accommodated, wherein:

the accommodation body is provided out of the tape printing apparatus when the tape is fed from the tape roll to the tape printing apparatus, a tape supplying body including the tape roll, a first member on which one end surface of the tape roll is placed, and a second member is accommodated in the tape roll accommodation part, the second member has a running-onto prevention part that is provided at other end surface of the tape roll, a tape receiving part that is provided at a bottom surface of the first member, and a connection part that is provided on a radially outer side of the tape roll and connects the running-onto prevention part and the tape receiving part to each other, and the tape roll accommodation part is provided with a rotation supporting part that rotatably supports the first member and a rotation prevention part that prevents rotation of the second member when the tape is fed from the tape roll and the tape roll and the first member integrally rotate with each other.

2. The accommodation body according to claim 1, wherein the cartridge accommodation part is provided between the tape roll accommodation part and the tape discharge port.

3. The accommodation body according to claim 1, wherein the rotation prevention part engages the connection part to prevent rotation of the second member.

4. The accommodation body according to claim 1, wherein the tape roll accommodation part is provided with a recessed part that is provided corresponding to the tape receiving part and determines a direction of the second member in a circumferential direction of the second member.

5. The accommodation body according to claim 1, wherein the cartridge accommodation part is provided with a cartridge retention part that retains the ribbon cartridge.

6. A tape printing system comprising:

a tape printing apparatus; and an accommodation body including:

an accommodation body part;

an accommodation lid part located on a first side of the accommodation body part; and accommodation leg parts that support the accommodation body part, the accommodation leg parts being located on a second side of the accommodation body part opposite to the first side and extending away from the second side in a direction orthogonal to a surface of the second side, the accommodation body part including:

a tape roll accommodation part in which a tape roll on which a tape to be fed to the tape printing apparatus is wound is accommodated, a wall part on which a tape discharge port from which the tape fed from the tape roll is to be discharged is provided, and a cartridge accommodation part in which a ribbon cartridge that has an ink ribbon and is to be installed in the tape printing apparatus is accommodated, the ribbon cartridge being capable of retaining the tape fed from the tape roll, wherein:

the accommodation body is provided out of the tape printing apparatus when the tape is fed from the tape roll to the tape printing apparatus, a tape supplying body including the tape roll, a first member on which one end surface of the tape roll is placed, and a second member is accommodated in the tape roll accommodation part, the second member has a running-onto prevention part that is provided at other end surface of the tape roll, a tape receiving part that is provided at a bottom surface of the first member, and a connection part that is provided on a radially outer side of the tape roll and connects the running-onto prevention part and the tape receiving part to each other, and the tape roll accommodation part is provided with a rotation supporting part that rotatably supports the first member and a rotation prevention part that prevents rotation of the second member when the tape is fed from the tape roll and the tape roll and the first member integrally rotate with each other.

7. The tape printing system according to claim 6, further comprising:

a coupling member that couples the tape printing apparatus and the accommodation body to each other.

* * * * *